US009189905B2

(12) United States Patent
Nishida et al.

(10) Patent No.: US 9,189,905 B2
(45) Date of Patent: Nov. 17, 2015

(54) COIN HANDLING MACHINE

(75) Inventors: Eisei Nishida, Hyogo (JP); Kazuhiro Koumoto, Hyogo (JP)

(73) Assignee: GLORY LTD., Himeji-Shi, Hyogo-Ken (JP)

( * ) Notice: Subject to any disclaimer, the term of this patent is extended or adjusted under 35 U.S.C. 154(b) by 697 days.

(21) Appl. No.: 12/736,568

(22) PCT Filed: Apr. 24, 2008

(86) PCT No.: PCT/JP2008/057895
§ 371 (c)(1),
(2), (4) Date: Oct. 20, 2010

(87) PCT Pub. No.: WO2009/130774
PCT Pub. Date: Oct. 29, 2009

(65) Prior Publication Data

US 2011/0039487 A1 Feb. 17, 2011

(51) Int. Cl.
*G07D 3/00* (2006.01)
*G07D 9/00* (2006.01)

(52) U.S. Cl.
CPC ..... *G07D 9/008* (2013.01)

(58) Field of Classification Search
CPC ..... G07D 3/128; G07D 9/008; G07D 3/16; G07D 3/02; G07D 3/06; G07D 3/00; G07D 3/10; G07D 3/04; G07D 3/065; G07D 9/04; G07D 1/00; G07D 9/00; G07D 3/14; G07F 1/047; G06M 7/04; G06M 3/02; F24F 3/00; A45C 1/02
USPC ..... 194/215; 453/6, 10, 12, 13, 33–35, 49, 453/57
See application file for complete search history.

(56) References Cited

U.S. PATENT DOCUMENTS 5,813,510 A * 9/1998 Rademacher ..... 194/206
7,568,972 B2 * 8/2009 Chung ..... 453/2
(Continued)

FOREIGN PATENT DOCUMENTS

EP 1 927 955 A1 6/2008
JP 2006-209345 8/2006 ..... G07D 9/00
(Continued)

OTHER PUBLICATIONS

European Search Report (dated May 12, 2011—6 pages).

*Primary Examiner* — Jeffrey Shapiro
(74) *Attorney, Agent, or Firm* — Renner, Kenner, Greive, Bobak, Taylor & Weber

(57) ABSTRACT

The present invention provides a coin handling machine 11 which can handle a large amount of coins, has a transportation structure which can be simplified, reduced in size and cost, and can reduce the occurrence of trouble such as coin jams. The coin handling machine 11 includes a depositing and dispensing unit 13 which processes depositing and dispensing of coins, and a replenishing and collecting unit 14 which replenishes coins to the depositing and dispensing unit 13 and collects coins from the depositing and dispensing unit 13. The depositing and dispensing unit 13 includes a depositing and dispensing transport path 25, a depositing and feeding unit 31, a plurality of storing and feeding units 32, and an escrow unit 38. Each of the depositing and feeding unit 31 and the plurality of storing and feeding units 32 includes a rotary disk 60 which rotates at a position inclined at a predetermined angle with respect to the horizontal direction, and a hopper which stores coins in an unaligned state on the surface side of the rotary disk 60. The replenishing and collecting unit 14 includes an overflow stacking unit 91 and a coin cassette 92, and includes a replenishment transport path 93 which transports coins fed out from the overflow stacking unit 91 and the coin cassette 92 to the depositing and dispensing unit 13.

12 Claims, 19 Drawing Sheets

(56) References Cited

U.S. PATENT DOCUMENTS

| | | | | |
|---|---|---|---|---|
| 7,654,891 | B2 * | 2/2010 | Enomoto et al. | 453/49 |
| 2001/0021633 | A1 * | 9/2001 | Orton et al. | 453/3 |
| 2002/0168931 | A1 * | 11/2002 | Nakajmima et al. | 453/3 |
| 2003/0116401 | A1 * | 6/2003 | Ishida et al. | 194/302 |
| 2003/0221933 | A1 * | 12/2003 | Morikawa | 194/302 |
| 2004/0074736 | A1 * | 4/2004 | Yang | 194/250 |
| 2006/0054455 | A1 * | 3/2006 | Kuykendall et al. | 194/217 |
| 2006/0183418 | A1 * | 8/2006 | Umeda | 453/12 |
| 2007/0151827 | A1 * | 7/2007 | Brandstrom et al. | 194/206 |

FOREIGN PATENT DOCUMENTS

| | | | |
|---|---|---|---|
| JP | 2007-004640 | 1/2007 | G07D 9/00 |
| WO | WO 2007/034699 | 3/2007 | G07D 1/00 |

* cited by examiner

COIN HANDLING MACHINE

TECHNICAL FIELD

The present invention relates to a coin handling machine which processes depositing and dispensing of coins.

BACKGROUND ART

Conventionally, as a coin handling machine which processes depositing and dispensing of coins, there is a coin handling machine to be used for, for example, ATMs (Automatic Teller Machines) and CDs (Cash Dispensers).

In this coin handling machine, when depositing coins, coins input from an inlet are received in a depositing and feeding unit and fed out one by one to a transport path, recognized by a recognition unit while being transported through the transport path, and coins recognized as normal are escrowed in denomination-specific escrow units or a bulk escrow unit, and in response to a coin storing command issued according to deposit confirmation, coins in the denomination-specific escrow unit are stored in denomination-specific storing and feeding units and coins in the bulk escrow unit are stored in a collecting unit. During dispensing processing, according to dispensing information, coins fed out one by one from the denomination-specific storing and feeding units are sent into the depositing and feeding unit, the coins are fed out to the transport path one by one from the depositing and feeding unit and transported through the transport path to an outlet and dispensed (for example, refer to Patent document 1).

In retail stores, etc., sales proceeds collected from many cash registers must be deposited and counted, and a change fund must be prepared in advance in each of the cash registers, and a coin handling machine which has these depositing function and change fund dispensing function, rarely causes trouble such as coin jams, and can be easily operated, has been demanded.

For these demands from stores, etc., a conventional coin handling machine to be used in ATMs, etc., is structured by assuming dealing of only a small coin depositing and dispensing amount, and the amount of coins that can be handled at a time is small, so that the machine is not suitable as a coin handling machine for a store etc., at which large amounts of coins must be deposited and dispensed. Moreover, many denomination-specific escrow units and storing and feeding units are configured so that coins are stacked and stored in a cylinder and fed out from the cylinder, however, coins easily stand up in the cylinder and cause trouble such as coin jams.

Further, as a coin handling machine capable of handling a large amount of coins, there are coin depositing and dispensing machines which are used in financial institutions such as banks, however, these coin depositing and dispensing machines are large in size and expensive, and have complicated transport paths, etc., and it is difficult to eliminate coin jams etc., so that these are not suitable for use at stores, etc.

Patent Document 1: Japanese Laid-Open Patent Publication No. 2007-4640 (pp. 18-20, FIG. 1).

DISCLOSURE OF THE INVENTION

Problems to be Solved by the Invention

In retail stores, etc., in order to make it possible to deposit and count sales proceeds collected from many cash registers and prepare a change fund in advance in each of the cash registers, a coin handling machine which has a depositing function and a dispensing function for large amounts of coins, and rarely causes trouble such as coin jams, and can be easily operated, has been demanded, however, conventional coin handling machines which have been used in ATMs and coin depositing and dispensing machines which have been used in financial institutions such as banks cannot satisfy this demand.

The present invention has been made in view of these circumstances, and an object thereof is to provide a coin handling machine which can handle a large amount of coins at a time, has a transportation structure which can be simplified, reduced in size and cost, and can reduce the occurrence of trouble such as coin jams.

Means to Solve the Problems

A coin handling machine of the present invention includes: a depositing and dispensing unit which sales processes depositing and dispensing of coins; and a replenishing and collecting unit which replenishes coins to the depositing and dispensing unit and collects coins from the depositing and dispensing unit, where the depositing and dispensing unit includes: a depositing and dispensing transport path which transports coins; an inlet/outlet which receives coins from the outside of the machine body and dispenses coins transported through the depositing and dispensing transport path to the outside of the machine body; a depositing and feeding unit including a rotary disk which rotates at a position inclined at a predetermined angle with respect to the horizontal direction and a hopper which stores coins in an unaligned state on the surface side of the rotary disk, and receiving and storing coins received from the inlet/outlet, and feeding out coins one by one to the depositing and dispensing transport path by rotation of the rotary disk; a recognition unit which recognizes coins being transported through the depositing and dispensing transport path; an escrow unit which receives and stores coins fed out from the depositing and feeding unit and recognized as normal coins by the recognition unit from the depositing and dispensing transport path; and a plurality of storing and feeding units which includes a rotary disk that rotates at a position inclined at a predetermined angle with respect to the horizontal direction and a hopper that stores coins in an unaligned state on the surface side of the rotary disk, receives and stores coins sent out from the escrow unit and transported through the depositing and dispensing transport path according to recognition results by the recognition unit in response to a coin storing command, and feeds out coins one by one to the depositing and dispensing transport path by rotation of the rotary disk in response to a coin dispensing command, where the replenishing and collecting unit includes: a coin storing unit which is capable of feeding out stored coins and to store coins sent from the depositing and dispensing unit; and a replenishment transport path which transports coins fed out from the coin storing unit to the depositing and dispensing unit.

The escrow unit of the coin handling machine of the present invention is positioned higher than the depositing and feeding unit, and sends coins to the depositing and feeding unit in response to the coin storing command.

The escrow unit of the coin handling machine of the present invention includes a rotary disk which rotates at a position inclined at a predetermined angle with respect to the horizontal direction and a hopper which stores coins in an unaligned state on the surface side of the rotary disk, and feeds out coins one by one to the depositing and dispensing transport path by rotation of the rotary disk in response to the coin storing command.

The coin storing unit of the coin handling machine of the present invention includes an overflow stacking unit which is fixedly disposed on the machine body, and receives and stores coins of a denomination of which the storing and feeding unit has become full among coins sent out from the escrow unit and transported through the depositing and dispensing transport path according to recognition results by the recognition unit in response to the coin storing command, and is capable of feeding out the stored coins, and a coin cassette which is removably disposed on the machine body and is capable of feeding out stored coins and store coins collected from the inside of the machine body.

The coin storing unit of the coin handling machine of the present invention stores coins in an unaligned state, and is capable of feeding out coins to the replenishment transport path by rotation of a belt constituting the bottom portion of a space storing the coins.

The replenishing and collecting unit of the coin handling machine of the present invention is disposed below the depositing and dispensing unit, and the replenishment transport path includes a horizontal transport unit which receives coins fed out from the coin storing unit and transports the coins horizontally and a vertical transport unit which transports replenishment coins upward from the horizontal transport unit.

The vertical transport unit of the replenishment transport path of the coin handling machine of the present invention is positioned on a side portion of the depositing and dispensing unit, and is capable of leaving a space between the vertical transport unit and the depositing and dispensing unit.

The coin storing unit of the coin handling machine of the present invention includes a reject box for storing rejected coins not recognized as normal coins by the recognition unit of the depositing and dispensing unit.

The reject box of the coin handling machine of the present invention includes an operational reject box which stores rejected coins at the time of depositing and dispensing operation, and a replenishment reject box which stores rejected coins at the time of replenishment.

The coin cassette of the coin handling machine of the present invention includes an operational reject box for storing rejected coins not recognized as normal coins by the recognition unit of the depositing and dispensing unit at the time of depositing and dispensing operation, and a replenishment reject box for storing rejected coins not recognized as normal coins by the recognition unit of the depositing and dispensing unit at the time of replenishment, and these operational reject box and replenishment reject box are removably attached to the machine body, integrally with the coin cassette.

The overflow stacking unit of the coin handling machine of the present invention includes an operational reject box for storing rejected coins not recognized as normal coins by the recognition unit of the depositing and dispensing unit at the time of depositing and dispensing operation, and a replenishment reject box for storing rejected coins not recognized as normal coins by the recognition unit of the depositing and dispensing unit at the time of replenishment, and these operational reject box and replenishment reject box are removably attached to the machine body.

The overflow stacking unit of the coin handling machine of the present invention includes a forgotten-to-be-taken box which stores forgotten-to-be-taken coins which were dispensed to the inlet/outlet and are not taken out, and an auxiliary box which can store coins, and these forgotten-to-be-taken box and auxiliary box are removable from the machine body.

Effects of the Invention

The coin handling machine of the present invention provides that each depositing and feeding unit and the plurality of storing and feeding units uses a configuration including a rotary disk which rotates at a position inclined at a predetermined angle with respect to the horizontal direction and a hopper which stores coins in an unaligned state on the surface side of the rotary disk, and receives coins from the depositing and dispensing transport path and feeds out coins one by one to the depositing and dispensing transport path by rotation of the rotary disk, so that while the coin handling machine is capable of handling a large amount of coins at a time, the coin handling machine has a transportation structure which can be simplified, reduced in size and cost, and can reduce the occurrence of trouble such as coin jams, replenish coins from the replenishing and collecting unit to the depositing and dispensing unit, handle a large amount of dispensed, store and collect coins sent from the depositing and dispensing unit, and handle a large amount of coins.

The escrow unit of the coin handling machine of the present invention is positioned higher than the depositing and feeding unit, and in response to a coin storing command, has only to eject the coins to the depositing and feeding unit, so that the configuration of the escrow unit can be simplified.

The escrow unit of the coin handling machine of the present invention uses a configuration that includes a rotary disk which rotates at a position inclined at a predetermined angle with respect to the horizontal direction and a hopper which stores coins in an unaligned state on the surface side of the rotary disk, and receives coins from the depositing and dispensing transport path and feeds out coins one by one to the depositing and dispensing transport path by rotation of the rotary disk, so that while a large amount of coins can be handled at a time, the transportation structure can be simplified, reduced in size and cost, and also reduce the occurrence of trouble such as coin jams.

The coin storing unit of the replenishing and collecting unit of the coin handling machine of the present invention includes an overflow stacking unit fixedly disposed on the machine body and a coin cassette removably disposed on the machine body, and the overflow stacking unit can be used to store coins of a denomination of which the storing and feeding unit has become full and to replenish these stored coins, and the coin cassette can be used to replenish coins from the outside and to collect coins from the inside of the machine body, and these can be adapted as appropriate.

The coin storing unit of the replenishing and collecting unit of the coin handling machine of the present invention stores coins in an unaligned state and is capable of feeding out coins to the replenishment transport path by rotation of the belt constituting the bottom portion of the space storing the coins, so that a large amount of coins can be handled.

In the replenishment transport path of the coin handling machine of the present invention, coins fed out from the coin storing unit are received by the horizontal transport unit and transported upward by the vertical transport unit, so that coins can be dropped and sent into the depositing and feeding unit, and the transportation structure can be simplified.

The vertical transport unit of the replenishment transport path positioned on the side portion of the depositing and dispensing unit of the coin handling machine of the present invention can leave a space between the vertical transport unit and the depositing and dispensing unit, so that at the occurrence of trouble, the depositing and dispensing unit can be easily dealt with.

The coin handling machine according to claim 1, the The coin storing unit of the replenishing and collecting unit of the coin handling machine of the present invention includes a reject box for storing rejected coins, so that a large amount of coins can be handled.

The coin handling machine of the present invention includes an operational reject box which stores rejected coins at the time of depositing and dispensing operation and a replenishment reject box which stores rejected coins at the time of replenishment, and the rejected coins can be managed separately at the time of depositing and dispensing operation and the replenishment.

The coin cassette of the coin handling machine of the present invention includes an operational reject box which stores rejected coins at the time of depositing and dispensing operation, and a replenishment reject box which stores rejected coins at the time of replenishment, and these operational reject box and replenishment reject box are removably attached to the machine body, integrally with the coin cassette, so that the rejected coins can be managed separately at the time of depositing and dispensing operation and replenishment, and a rejected coin handling method can be freely selected.

The overflow stacking unit of the coin handling machine of the present invention includes an operational reject box which stores rejected coins at the time of depositing and dispensing operation, and a replenishment reject box which stores rejected coins at the time of replenishment, and these operational reject box and replenishment reject box are separable from the machine body, so that the rejected coins can be managed separately at the time of depositing and dispensing operation and replenishment, and a rejected coin handling method can be freely selected.

The overflow stacking unit of the coin handling machine of the present invention includes a forgotten-to-be-taken box which stores forgotten-to-be-taken coins which were dispensed to the inlet/outlet and are not taken out, and an auxiliary box which can store coins, and these forgotten-to-be-taken box and auxiliary box are separable from the machine body, so that the coins forgotten to be taken can be managed separately, and the auxiliary box can be used for storing predetermined coins which can be arbitrarily set.

REFERENCE NUMERALS

Figure 1:
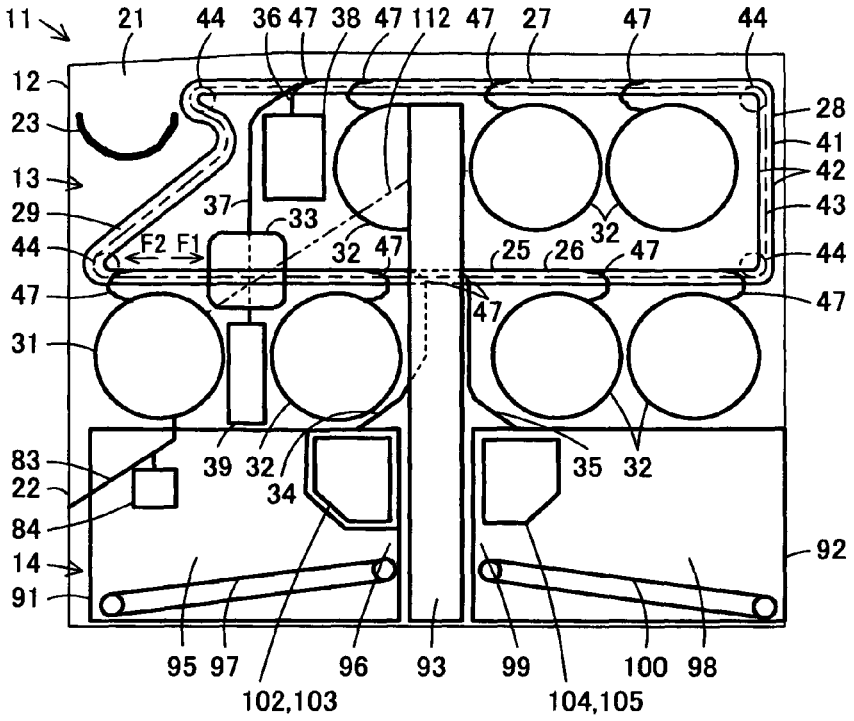
FIG. 1 is a side view of an internal structure of a coin handling machine showing a first embodiment of the present invention.

11 Coin handling machine
12 Machine body
13 Depositing and dispensing unit
14 Replenishing and collecting unit
21 Inlet/outlet
25 Depositing and dispensing transport path
31 Depositing and feeding unit
32 Storing and feeding unit
33 Recognition unit
38 Escrow unit
60 Rotary disk
61 Hopper
91 Overflow stacking unit as coin storing unit
92 Coin cassette as coin storing unit
93 Replenishment transport path
97, 100 Belt
102, 104 Operational reject box as reject box
103, 105 Replenishment reject box as reject box
108 Horizontal transport unit
109 Vertical transport unit
127 Forgotten-to-be-taken box
128 Auxiliary box

BEST MODE FOR CARRYING OUT THE INVENTION

Hereinafter, embodiments of the present invention will be described with reference to the drawings.

FIG. 1 to FIG. 13 show a first embodiment.

Figure 2:
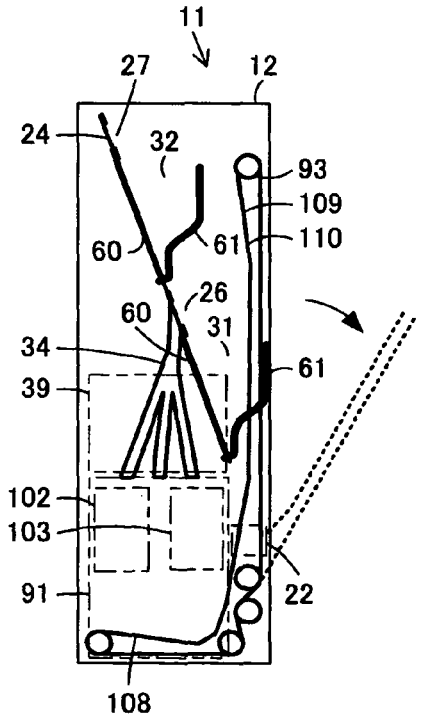
FIG. 2 is a front view showing the internal structure of the same coin handling machine.

As shown in FIG. 1 and FIG. 2, the coin handling machine 11 includes a machine body 12, and at an upper portion inside this machine body 12, a depositing and dispensing unit 13 which processes depositing and dispensing of coins is disposed, and at the lower portion inside the machine body 12, a replenishing and collecting unit 14 which replenishes coins to the depositing and dispensing unit 13 and receives coins from the depositing and dispensing unit 13 is disposed. The depositing and dispensing unit 13 and the replenishing and collecting unit 14 can be pulled out forward or rearward from the machine body 12 by an unlocking operation with a key for maintenance or in case of occurrence of an error such as a coin jam.

On the front side upper surface of the machine body 12, an inlet/outlet 21 for receiving coins to be deposited and dispensing coins sent out from the inside is provided. On the front face of the machine body 12, a foreign material returning port 22 for returning foreign material, etc., mixed with deposited coins is provided.

Below the inlet/outlet 21, a tray 23 for receiving and storing coins is disposed, and is capable of ejecting coins downward by turning over of the tray 23.

Inside the depositing and dispensing unit 13, a base 24, the upper portion of which is inclined at a predetermined angle to the left side direction as viewed from the front face, is disposed, and on the surface side facing the upper side of this base 24, a depositing and dispensing transport path 25 for transporting coins is disposed. This depositing and dispensing transport path 25 includes a first transport path portion 26 provided substantially horizontally in the front-rear direction of the machine body 12, a second transport path portion 27 provided substantially horizontally in the front-rear direction of the machine body 12 above the first transport path portion 26, a third transport path portion 28 connecting the rear portions of the first transport path portion 26 and the second transport path portion 27 in the up-down direction, and a fourth transport path portion 29 connecting the front portions of the first transport path portion 26 and the second transport path portion 27 in the up-down direction, and is formed annularly. Here, the direction of transporting coins from the first transport path portion 26 to the third transport path portion 28 and the second transport path portion 27 is referred to as a depositing transporting direction F1 as a first transporting direction, on the other hand, the direction of transporting coins from the second transport path portion 27 to the third transport path portion 28, the first transport path portion 26, and the fourth transport path portion 29 is referred to as a dispensing transporting direction F2 as a second transporting direction.

A depositing and feeding unit 31 is connected to and disposed on the front side of the first transport path portion 26 of the depositing and dispensing transport path 25, and a plurality of denomination-specific storing and feeding units 32 are connected to and disposed on the rear side of the depositing and feeding unit 31 of the first transport path portion 26 and the second transport path portion 27. The depositing and feeding unit 31 is able to divert and receive coins being transported in the dispensing transporting direction F2 inside the depositing and dispensing transport path 25, and is able to feed out coins in the depositing transporting direction F1 to the depositing and dispensing transport path 25. The plurality of storing and feeding units 32 are able to divert and receive coins being transported in the depositing transporting direction F1 inside the depositing and dispensing transport path 25, and are able to feed out coins in the dispensing transporting direction F2 to the depositing and dispensing transport path 25.

The depositing and feeding unit 31 is positioned below the inlet/outlet 21 and the tray 23, and is able to receive and store coins ejected from the tray 23 through a chute not shown.

In the first transport path portion 26 of the depositing and dispensing transport path 25, a recognition unit 33 which recognizes selectively as appropriate at least denominations, authenticity, and fitness of coins being transported is disposed between the depositing and feeding unit 31 and the storing and feeding units 32.

To the first transport path portion 26 of the depositing and dispensing transport path 25, an overflow passage 34 and a collecting passage 35 which is able to divert coins being transported in the depositing transporting direction F1 are connected between the forefront storing and feeding unit 32 and the storing and feeding unit 32 behind the forefront storing and feeding unit. The lower portions of these overflow passage 34 and collecting passage 35 are connected to the replenishing and collecting unit 14.

To the second transport path portion 27 of the depositing and dispensing transport path 25, an escrow passage 36 which is able to divert coins being transported in the depositing transporting direction F1 is connected ahead of the forefront storing and feeding unit 32, and a forgotten-to-be-taken passage 37 which is able to sort coins into the escrow passage 36 is connected.

To the lower portion of the escrow passage 36, an escrow unit 38 which collectively escrows coins in an unaligned state and is able to eject escrowed coins to the depositing and feeding unit 31 through a chute not shown is connected.

The lower portion of the forgotten-to-be-taken passage 37 is connected to a forgotten-to-be-taken box 39 removable from the machine body 12.

Moreover, the depositing and dispensing transport path 25 includes a passage surface 41 which is formed on the surface of the base 24 and with which surfaces of coins come into contact, and guide portions 42 on both sides for guiding the peripheral edges of the coins on both sides of the passage surface 41. Further, a belt 43 as an endless transporting member which transports coins inside the depositing and dispensing transport path 25 is wound around a plurality of pulleys 44.

Figure 3:
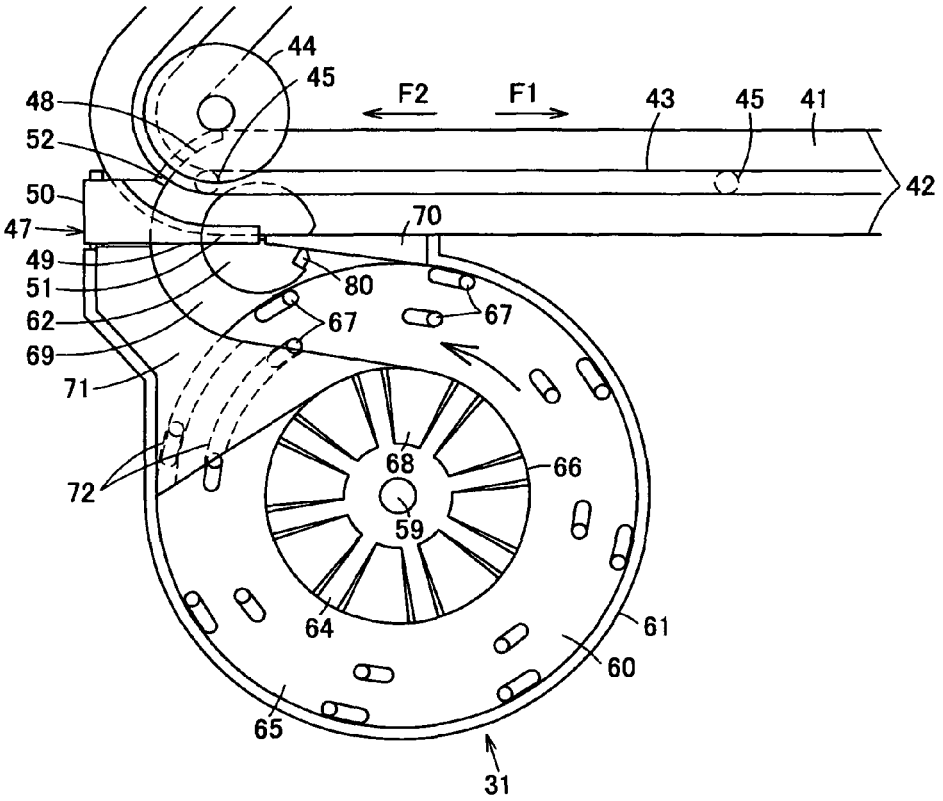
FIG. 3 is a side view showing a depositing and feeding unit of the same coin handling machine.

As shown in FIG. 3, from the surface of the belt 43 opposed to the passage surface 41, a plurality of pins 45 are provided to project at predetermined pitches in the belt longitudinal direction so that a coin is received between two pins 45 adjacent to each other and the coin is transported while being pushed and moved by the pins 45 by rotation of the belt 43.

Moreover, the belt 43 rotates forward and reversely in both directions of the depositing transporting direction F1 and the dispensing transporting direction F2 by driving of a motor not shown to make it possible to transport coins inside the depositing and dispensing transport path 25 forward and reversely.

In addition, as shown in FIG. 1, in the depositing and dispensing transport path 25, sorting members 47 which selectively sort coins depending on whether the coins are input or output by the depositing and feeding unit 31 and each storing and feeding unit 32 and the depositing and dispensing transport path 25 or the coins being transported by the belt 43 are allowed to pass to the downstream side in the transporting direction, are disposed at connecting portions between the depositing and feeding transport path 25 and the depositing and feeding unit 31, and between the depositing and feeding transport path 25 and the respective storing and feeding unit 32. Further, in the depositing and dispensing transport path 25, sorting members 47 which selectively sort coins depending on whether the coins are taken into the respective passages 34, 35, and 36 from the depositing and dispensing transport path 25 or coins being transported by the belt 43 are allowed to pass to the downstream side in the transporting direction, are disposed at connecting portions of the overflow passage 34, the collecting passage 35, and the escrow passage 36. Moreover, the sorting members are different only in orientations etc., and their basic structures and operations for sorting coins are the same.

FIG. 3 shows a sorting member 47 of the depositing and feeding unit 31. This sorting member 47 includes integrally a guide portion 48 which guides coins, a closing portion 49 which blocks the entrance of coins by closing the coin gateway of the depositing and feeding unit 31, and a support portion 50 which supports the guide portion 48 and the closing portion 49 swingably.

The guide portion 48 is provided to have a concave curved surface so as be able to make smooth the input and output of coins into and from the depositing and dispensing transport path 25.

The closing portion 49 is provided with a guide surface 51 which becomes flush with the guide portion 42 on the lower side and guides a peripheral edge of a coin in a state where the coin gateway of the depositing and feeding unit 31 is closed.

The support portion 50 is turnable around an axis as a supporting point in the width direction of the depositing and dispensing transport path 25, and is turned by an electric driving unit such as a solenoid. And, when sorting a coin from the depositing and dispensing transport path 25 into the depositing and feeding unit 31 and when feeding out a coin from the depositing and feeding unit 31 to the depositing and dispensing transport path 25, the guide portion 48 projects from the passage surface 41 of the depositing and dispensing transport path 25, and the sorting member 47 is positioned at a coin sorting position at which the closing portion 49 makes the coin gateway of the depositing and feeding unit 31 an open state. On the other hand, when a coin is not sorted from the depositing and dispensing transport path 25 into the depositing and feeding unit 31 and when a coin is not fed out from the depositing and feeding unit 31 to the depositing and dispensing transport path 25, the guide portion 48 sinks under the passage surface 41 of the depositing and dispensing transport path 25, and the sorting member 47 is positioned at a coin passing position at which the closing portion 49 makes the coin gateway of the depositing and dispensing transport path 25 a closed state. In the passage surface 41 of the depositing and dispensing transport path 25, an opening for projecting and withdrawing the guide portion 48 is formed. On the guide portion 48 of the sorting member 47, a groove portion 52 which avoids interference with the belt 43 when projecting from the depositing and dispensing transport path 25 is formed.

In addition, each of the sorting members 47 for each of the storing and feeding units 32 and the respective passages 34, 35, and 36 have a configuration different only in orientation as described above, and basically similar to the configuration of the sorting member 47 for the depositing and feeding unit 31, and are driven by electric driving units.

Figure 4:
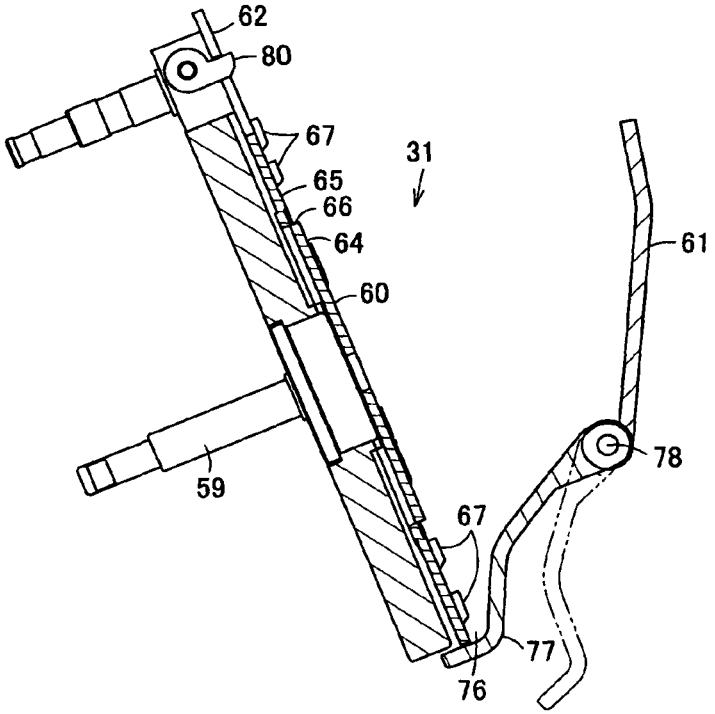
FIG. 4 is a sectional view of the same depositing and feeding unit.

Moreover, as shown in FIG. 3 and FIG. 4, the depositing and feeding unit 31 includes a rotary disk 60 rotatable around a rotary axis 59 at a position inclined at a predetermined angle with respect to the horizontal direction, a hopper 61 which retains coins by the hopper and the surface side of the rotary disk 60, and a delivery disk 62 disposed near the coin gateway of the depositing and feeding unit 31, etc.

The rotary disk 60 is inclined rightward with respect to the horizontal direction as viewed from the front face of the machine body 12 by a rotary axis 59 attached rotatably to the machine body 12 side, and is disposed so that the left side of the rotary disk 60 becomes higher and the right side becomes lower, and the surface of the rotary disk 60 is opposed to the diagonally upper right of the machine body 12. The rotary disk 60 is rotatingly driven by a motor in a feeding-out rotating direction (the arrow direction of FIG. 6) of feeding out coins to the depositing and dispensing transport path 25 in conjunction with the belt 43 and the delivery disk 62. The rotary disk 60 may be allowed to be rotatingly driven in an opposite feeding-out rotating direction opposite to the feeding-out rotating direction for eliminating coin jams when a coin jam occurs.

On the surface of the rotary disk 60, a circular high portion 64 is formed in the central region, and an annular low portion 65 is formed in an outer peripheral region of the high portion 64. Between the high portion 64 and the low portion 65 of the rotary disk 60, a stepped portion 66 that is slightly smaller than the minimum coin thickness of the coins to be processed and on which the peripheral edge of one coin is placed in the thickness direction, is formed.

On the low portion 65, a plurality of pickup members 67 projecting from the surface of the rotary disk 60 are disposed at predetermined pitches along two lines of circumferential directions of an inner peripheral side circumferential direction and an outer peripheral side circumferential direction. And, when the rotary disk 60 rotates in the feeding-out rotating direction, each pickup member 67 on the inner peripheral side holds one coin each by the pickup member 67 and the stepped portion 66 and picks the coin up onto the upper region on the rotary disk 60, and each pickup member 67 on the outer peripheral side pushes the coin picked up onto the upper region on the rotary disk 60 by each pickup member 67 on the inner peripheral side toward the coin gateway of the depositing and feeding unit 31 and delivers the coin to the delivery disk 62.

The stepped portions 66 are provided at respective positions at which coins can be held one each by the stepped portions 66 and the respective pickup members 67. Therefore, a plurality of stepped portions 66 are provided in the circumferential direction. Between these stepped portions 66, sliding-down portions 68 which cause coins to slide downward not being held by the pickup members 67 and the stepped portions 66 by forming the steps between the high portion 64 and the low portion 65 into slope surfaces, are formed.

In the upper region on the rotary disk 60, a guide passage 69 for feeding out coins picked up onto the upper region on the rotary disk 60 by the pickup members 67 toward the coin gateway of the depositing and feeding unit 31 is formed. This guide passage 69 is formed between the passage surface 41 flush with the surface of the rotary disk 60 and continuing to the depositing and dispensing transport path 25 and the upper and lower guide members 70 and 71.

The upper guide member 70 is provided to project from the surfaces of the rotary disk 60 and the passage surface 41 from the upper region of the rotary disk 60 to one edge portion side of the coin gateway of the depositing and feeding unit 31.

The lower guide member 71 is provided from the stepped portion 66 side to the other edge portion side of the coin gateway of the depositing and feeding unit 31 while being opposed to the surface of the low portion 65 via a gap which coins do not enter. The inner edge facing the inside of the guide passage 69 of the guide member 71 is formed into a curved surface continuing to the guide portion 48 of the sorting member 47. On the surface opposed to the low portion 65 of the guide member 71, groove portions 72 through which the respective pickup members 67 rotatably moving pass are formed. And, by the guide member 71, it is configured such that coins picked up by the pickup members 67 are received from the stepped portions 66 and guided to the coin gateway of the depositing and feeding unit 31.

Moreover, the hopper 61 is formed into a shape opposed to and covering the surface side of the rotary disk 60 and opened upward so as be able to receive coins from above.

On the lower portion of the hopper 61, a discharge port 76 is formed, and to this discharge port 76, a discharge gate 77 is attached so as to be able to open and close around an axis 78 as a supporting point on the upper portion side. The discharge gate 77 is driven to open and close by a gate driving unit such as a motor or solenoid via the axis 78.

Further, the delivery disk 62 is disposed rotatably at a position across the guide passage 69 and the depositing and dispensing transport path 25 so that the surface of the delivery disk 62 becomes flush with the passage surface 41. On the outer peripheral edge portion of the delivery disk 62, a projection 80 which comes into contact with a coin and feeds out the coin from the rotary disk 60 side to the depositing and dispensing transport path 25 side is provided to project.

The delivery disk 62 rotates in conjunction with the belt 43 of the depositing and dispensing transport path 25, and when the belt 43 moves in the depositing transporting direction F1, the delivery disk 62 rotates in a feeding-out rotating direction in which the projection 80 moves from the coin gateway of the depositing and feeding unit 31 to the inside of the depositing and dispensing transport path 25 and feeds out coins by the projection 80 from the rotary disk 60 side to the depositing and dispensing transport path 25, and when the belt 43 moves in the dispensing transporting direction F2, the delivery disk 62 rotates in an opposite feeding-out rotating direction in which the projection 80 moves from the depositing and dispensing transport path 25 side to the inside of the coin gateway of the depositing and feeding unit 31.

The configurations of the rotary disk 60, the hopper 61, and the delivery disk 62, etc., of the depositing and feeding unit 31 are described above, and each storing and feeding unit 32 also includes a rotary disk 60, a hopper 61, and a delivery disk 62, etc., and has basically the same configuration except that only the orientation is different as described above. However, the discharge port 76 and the discharge gate 77, etc., of the hopper 61 are not provided in each storing and feeding unit 32.

Moreover, below the depositing and feeding unit 31, a foreign material chute 83 which receives foreign material remaining in the depositing and feeding unit 31 and sends it into the foreign material returning port 22 according to opening of the discharge gate 77 of the hopper 61 of the depositing and feeding unit 31 is disposed. In the middle of this foreign material chute 83, a foreign material collecting box 84 that collects foreign material in the case of operation during which foreign material is not returned to the foreign material returning port 22 is removably disposed on the machine body 12.

Next, as shown in FIG. 1 and FIG. 2, the replenishing and collecting unit 14 includes, as a coin storing unit, an overflow stacking unit 91 fixedly disposed on a front side lower position inside the machine body 12 and a coin cassette 92 removably disposed on a rear side lower position of the rear surface inside the machine body 12, and further, between the overflow stacking unit 91 and the coin cassette 92, a replenishment transport path 93 which transports coins fed out from the overflow stacking unit 91 and the coin cassette 92 to the depositing and dispensing unit 13 above.

Inside the overflow stacking unit 91, a storing space 95 which stores coins in an unaligned state, and a belt 97 which constitutes the bottom portion of the storing space 95 and feeds out coins from a feeding port 96 on the rear surface to the replenishment transport path 93 are disposed.

In the coin cassette 92, a storing space 98 which stores coins in an unaligned state and a belt 100 which constitutes the bottom portion of the storing space 98 and feeds out coins from a feeding port 99 on the rear surface to the replenishment transport path 93 is disposed.

The overflow stacking unit 91 includes an operational reject box 102 as a reject box for storing rejected coins not recognized as normal coins by the recognition unit 33 of the depositing and dispensing unit 13 at the time of depositing and dispensing operation, and a replenishment reject box 103 as a reject box for storing rejected coins not recognized as normal coins by the recognition unit 33 of the depositing and dispensing unit 13 at the time of replenishment. These operational reject box 102 and replenishment reject box 103 are configured as separation types separately removable from the machine body 12.

The coin cassette 92 includes an operational reject box 104 as a reject box for storing rejected coins not recognized as normal coins by the recognition unit 33 of the depositing and dispensing unit 13 at the time of depositing and dispensing operation, and a replenishment reject box 105 as a reject box for storing rejected coins not recognized as normal coins by the recognition unit 33 of the depositing and dispensing unit 13 at the time of replenishment. These operational reject box 104 and replenishment reject box 105 are configured as integral types removably attachable to the machine body 12, integrally with the coin cassette 92.

Moreover, it is configured such that, by a switching mechanism not shown provided in the overflow passage 34, coins guided from the overflow passage 34 are switched to and stored in any of the storing space 95, the operational reject box 102, and the replenishment reject box 103 of the overflow stacking unit 91.

Further, it is configured such that, by a switching mechanism not shown provided in the collecting passage 35, coins guided from the collecting passage 35 are switched to and stored in any of the storing space 98, the operational reject box 104, and the replenishment reject box 105 of the coin cassette 92.

The replenishment transport path 93 includes a conveyor 110 provided with a horizontal transport unit 108 which receives coins fed out from the overflow stacking unit 91 and the coin cassette 92 and a vertical transport unit 109 which transports coins upward from the horizontal transport unit 108. The vertical transport unit 109 is disposed on a side portion of the depositing and dispensing unit 13 opposed to the depositing and dispensing transport path 25, the depositing and feeding unit 31, and the storing and feeding unit 32, and is swingable between a position at which the vertical transport unit 109 is disposed inside the machine body 12 and transports coins as shown by the solid line in FIG. 2, and a position at which the vertical transport unit 109 moves to the outside of the machine body 12 and is capable of leaving a space between the vertical transport unit 109 and the depositing and dispensing unit 13 as shown by the alternate long and two short dashed line in FIG. 2.

The replenishment transport path 93 includes a replenishment chute 112 that receives coins transported upward by the vertical transport unit 109 of the conveyor 110 and guides coins to the depositing and feeding unit 31.

Further, a control unit which controls the coin handling machine 11, an operation unit which performs operations relating to depositing and dispensing processing, a display unit which displays various indications, etc., are provided although these are not shown.

Next, the operation and effect of the first embodiment will be described.

First, in FIG. 5, deposit processing will be described.

Figure 5:
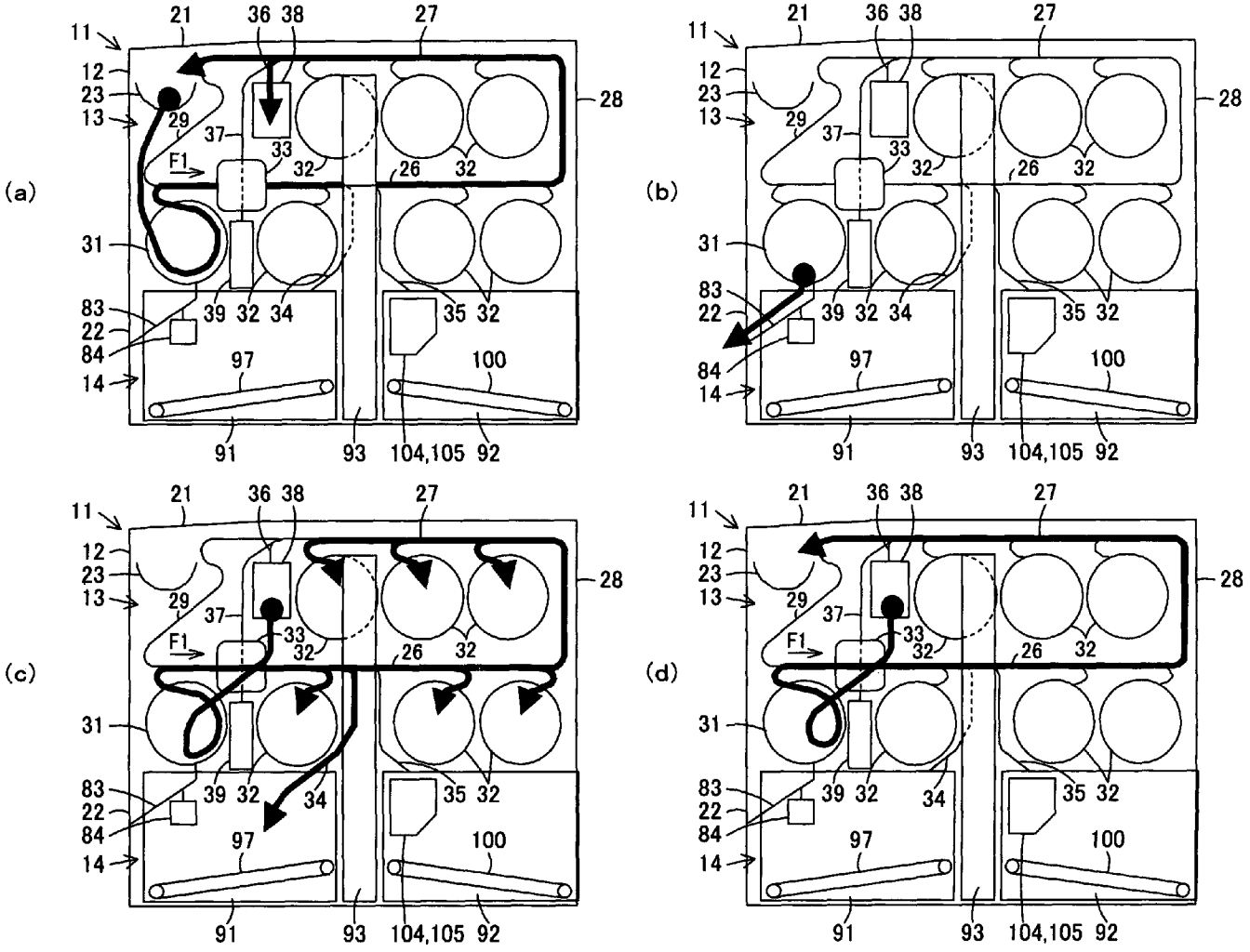
FIG. 5 show deposit processing of the same coin handling machine, and FIG. 5(*a*) is an explanatory view showing a deposited coin counting and escrowing operation, FIG. 5(*b*) is an explanatory view showing a foreign material returning operation, FIG. 5(*c*) is an explanatory view showing an escrowed coin storing operation, and FIG. 5(*d*) is an explanatory view showing an escrowed coin returning operation.

FIG. 5(*a*) shows a deposited coin counting and escrowing operation in deposit processing.

Coins input into the tray 23 from the inlet/outlet 21 of the machine body 12 are ejected downward by turning over of the tray 23, and are received in the depositing and feeding unit 31 through a chute not shown. The tray 23 is restored to the posture for receiving and storing coins after being turned over.

Coins received in the depositing and feeding unit 31 are fed out one by one to the depositing and dispensing transport path 25, the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted from the depositing and dispensing transport path 25 into the escrow unit 38 by the sorting member 47 of the escrow unit 38, and stored in the escrow unit 38.

A coin not recognized as a normal coin as a result of recognition by the recognition unit 33 passes through the position of the escrow unit 38 and is ejected to the tray 23 restored to the posture for receiving and storing coins from the depositing and dispensing transport path 25, and returned.

Also, FIG. 5(*b*) shows a foreign material returning operation in deposit processing.

Based on detection by a sensor not shown which detects coins in the depositing and feeding unit 31, when it is judged that a foreign material was not fed out from the depositing and feeding unit 31 and remains, or when all coins are completely fed out from the depositing and feeding unit 31, the discharge gate 77 of the hopper 61 of the depositing and feeding unit 31 is opened, and a foreign material such as a clip, a piece of paper, or a deformed coin which was not fed out from the depositing and feeding unit 31 and remains in the depositing and feeding unit 31 is ejected to the foreign material chute 83 below, and returned to the foreign material returning port 22 or collected in the foreign material collecting box 84. The location to which the foreign material is returned can be selected and set according to the operation method of the coin handling machine 11.

Also, FIG. 5(*c*) shows an escrowed coin storing operation in deposit processing.

After the coin counting and escrowing operation is finished for all input coins, when a coin storing command is issued by an operation on the operation unit, coins in the escrow unit 38 are ejected to the depositing and feeding unit 31. The coins are fed out one by one from the depositing and feeding unit 31 to the depositing and dispensing transport path 25, the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted from the depositing and dispensing transport path 25 into the storing and feeding unit 32 which stores coins of the corresponding denomination by the sorting member 47 of the storing and feeding unit 32, and stored in the storing and feeding unit 32.

When the number of stored coins in the storing and feeding unit 32 reaches a predetermined number, subsequent coins of the corresponding denomination are regarded as overflowing coins, and are sorted into the overflow passage 34 by the sorting member 47 of the overflow passage 34 and sent into and stored in the storing space 95 of the overflow stacking unit 91 through the overflow passage 34.

A coin not recognized as a normal coin as a result of recognition by the recognition unit 33 is sorted into the overflow passage 34 by the sorting member 47 of the overflow passage 34 and sent into and stored in the operational reject box 102 of the overflow stacking unit 91 through the overflow passage 34.

Further, FIG. 5(*d*) shows an escrowed coin returning operation in deposit processing.

After the counting and escrowing operation is finished for all input coins, when a coin returning command is issued by an operation on the operation unit, coins in the escrow unit 38 are ejected to the depositing and feeding unit 31. Coins are fed out one by one from the depositing and feeding unit 31 to the depositing and dispensing transport path 25, the coins fed out into the depositing and dispensing transport path 25 are transported one by one in the depositing transporting direction F1 by the belt 43, ejected to the tray 23 of the inlet/outlet 21 from the depositing and dispensing transport path 25, and returned.

Next, dispensing processing will be described in FIG. 6.

Figure 6:
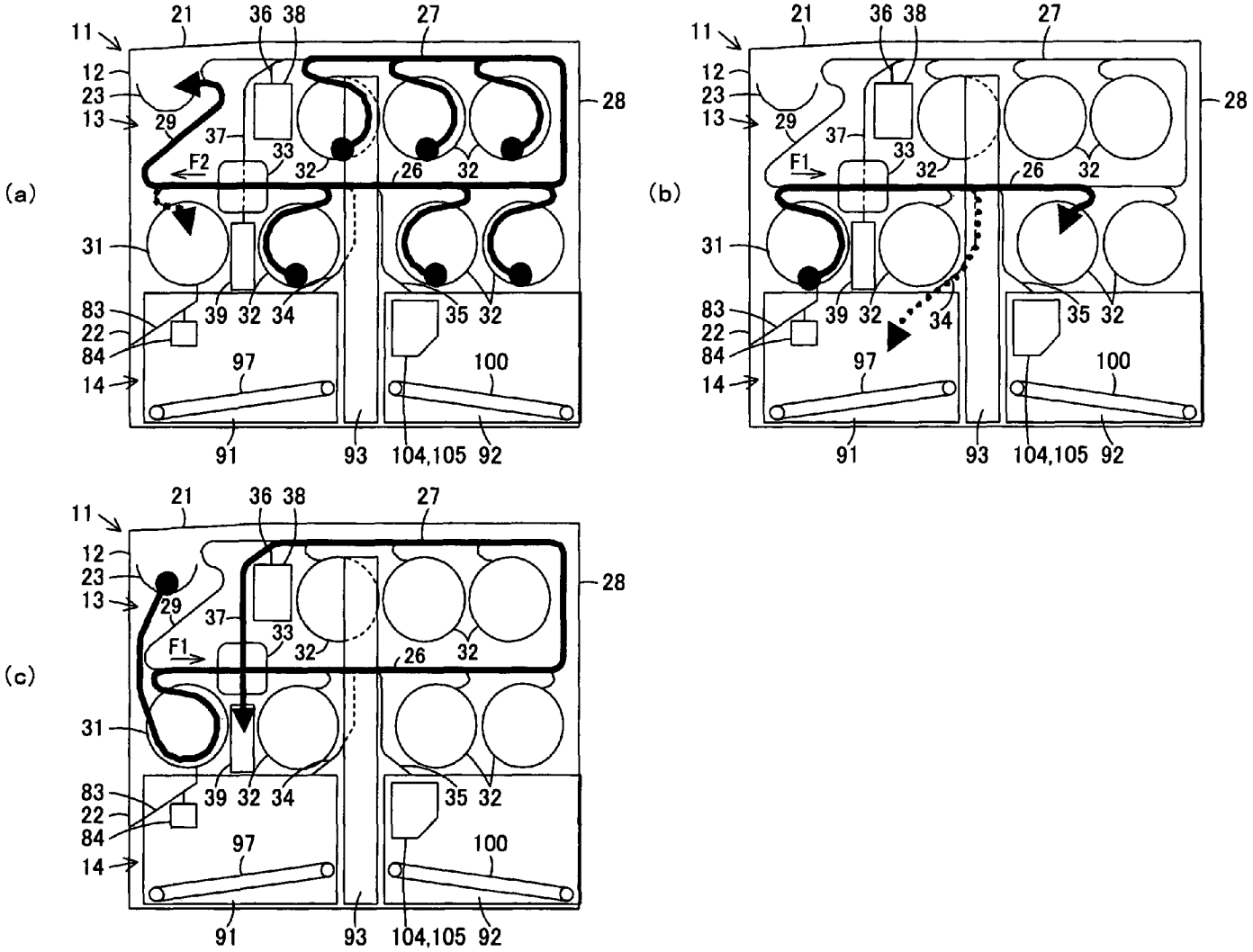
FIG. 6 shows dispensing processing of the same coin handling machine, and FIG. 6(*a*) is an explanatory view showing a coin counting and dispensing operation, FIG. 6(*b*) is an explanatory view showing a returning operation for coins not recognized as normal coins, and FIG. 6(*c*) is an explanatory view showing a collecting operation for coins forgotten to be taken.

FIG. 6(*a*) shows a coin counting and dispensing operation in dispensing processing.

According to an operation on the operation unit, when a coin dispensing command including a denomination and a number of coins to be dispensed or an amount of money to be dispensed is received, coins in the corresponding storing and feeding unit 32 are fed out one by one to the depositing and dispensing transport path 25, and the coins fed out into the depositing and dispensing transport path 25 are transported one by one in the dispensing transporting direction F2 by the belt 43, and the coins being transported are recognized by the recognition unit 33. When coins are dispensed from a plurality of storing and feeding units 32, coins are dispensed in order in such a manner that coins are dispensed from any one of storing and feeding units 32, and after the coins to be dispensed from this storing and feeding unit 32 are completely dispensed, coins to be dispensed from the next storing and feeding unit 32 are dispensed. Moreover, it is also possible that, to prevent interference of coins fed out into the depositing and dispensing transport path 25 with the sorting members 47 corresponding to other storing and feeding units 32, the plurality of corresponding storing and feeding units 32 are operated concurrently by matching the timings of feeding coins in the respective storing and feeding units 32 to the depositing and dispensing transport path 25.

A coin recognized as a normal coin as a result of recognition by the recognition unit 33 is ejected from the depositing and dispensing transport path 25 to the tray 23 of the inlet/outlet 21.

A coin not recognized as a normal coin as a result of recognition by the recognition unit 33 is sorted into and stored in the depositing and feeding unit 31 from the depositing and dispensing transport path 25 by the sorting member 47 of the depositing and feeding unit 31. A denomination of a coin not recognized as a normal coin can be known from a dispensing timing from the storing and feeding unit 32 and a timing at which the coin reaches the recognition unit 33 by being transported by the belt 43, so that one coin is additionally dispensed from the storing and feeding unit 32 of the corresponding denomination.

Then, coins to be dispensed are dispensed to the tray 23 of the inlet/outlet 21.

Moreover, FIG. 6(*b*) shows a returning operation for a coin not recognized as a normal coin in dispensing processing.

From the depositing and feeding unit 31 storing coins not recognized as normal coins, coins in the depositing and feeding unit 31 are fed out one by one to the depositing and dispensing transport path 25, and the coins fed out into the depositing and dispensing transport path 25 are transported one by one in the depositing transporting direction F1 by the belt 43, and the coins being transported are re-recognized by the recognition unit 33.

A coin recognized as a normal coin as a result of re-recognition by the recognition unit 33 is sorted into the storing and feeding unit 32 storing coins of the corresponding denomination from the depositing and dispensing transport path 25 by the sorting member 47 of the storing and feeding unit 32, and stored in the storing and feeding unit 32.

A coin not recognized as a normal coin as a result of re-recognition by the recognition unit 33 is sorted into the overflow passage 34 by the sorting member 47 of the overflow passage 34, and sent into and stored in the operational reject box 102 of the overflow stacking unit 91 through the overflow passage 34.

Also, FIG. 6(*c*) shows a collecting operation for coins forgotten to be taken in dispensing processing.

When a sensor not shown detects that coins are not taken out even after a predetermined time elapses since dispensing of the coins to be dispensed to the tray 23 of the inlet/outlet 21, it is judged that the coins have been forgotten to be taken out, so that the coins are ejected to the depositing and feeding unit 31 by turning over the tray 23, the coins received in the depositing and feeding unit 31 are fed out one by one to the depositing and dispensing transport path 25, the coins fed into the depositing and dispensing transport path 25 are transported one by one in the depositing transporting direction F1 by the belt 43, and these coins being transported are recognized by the recognition unit 33.

After recognition by the recognition unit 33, coins are sorted from the depositing and dispensing transport path 25 by the sorting member 47 of the escrow unit 38, and the sorted coins are collected in the forgotten-to-be-taken box 39 through the forgotten-to-be-taken passage 37.

Figure 7:
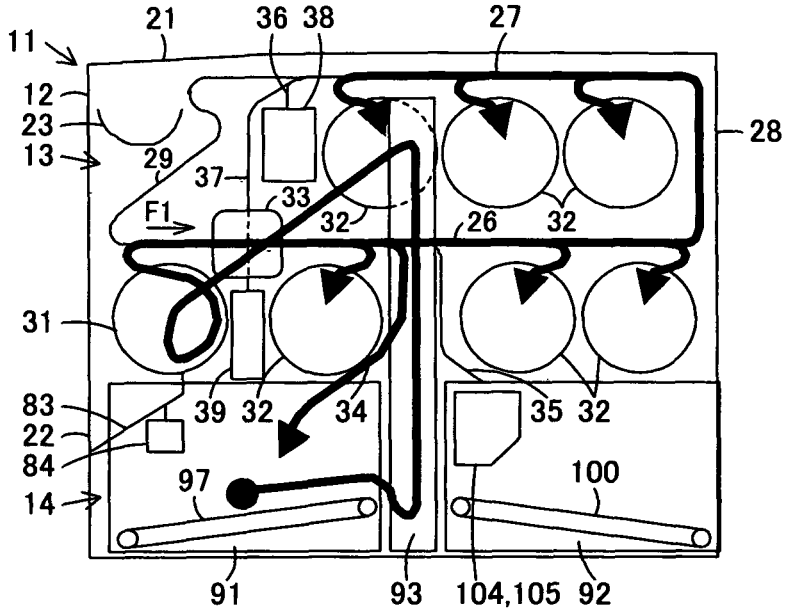
FIG. 7 is an explanatory view showing replenishment processing from the overflow stacking unit of the same coin handling machine.

Next, in FIG. 7, replenishment processing from the overflow stacking unit 91 will be described.

This replenishment processing from the overflow stacking unit 91 is performed when the coin amount in the storing and feeding unit 32 of a certain denomination decreases and coins of the corresponding denomination are stored in the overflow stacking unit 91 during operation of the coin handling machine 11.

The belt 97 of the overflow stacking unit 91 rotates to eject coins in the overflow stacking unit 91 to the conveyor 110 of the replenishment transport path 93. The coins are transported upward by the vertical transport unit 109 of the conveyor 110, ejected to the replenishment chute 112 from the upper portion of the vertical transport unit 109 and sent into the depositing and feeding unit 31 through the replenishment chute 112.

Coins are fed out one by one from the depositing and feeding unit 31 to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted from the depositing and dispensing transport path 25 into the storing and feeding unit 32 storing coins of the corresponding denomination by the sorting member 47 of the storing and feeding unit 32, and stored in the storing and feeding unit 32.

When the number of stored coins in the storing and feeding unit 32 reaches a predetermined number, subsequent coins of the corresponding denomination are regarded as overflowing coins, and are sorted into the overflow passage 34 by the sorting member 47 of the overflow passage 34, and sent into and stored in the storing space 95 of the overflow stacking unit 91 through the overflow passage 34.

A coin not recognized as a normal coin as a result of recognition by the recognition unit 33 is sorted into the overflow passage 34 by the sorting member 47 of the overflow passage 34, and sent into and stored in the replenishment reject box 103 of the overflow stacking unit 91 through the overflow passage 34.

Further, when depositing and dispensing processing becomes necessary during the replenishment processing, the coin feeding from the overflow stacking unit 91 is temporarily halted, and after all coins being transported are transported, the required depositing and dispensing processing is performed, and after the processing is performed, the replenishment processing is restarted.

Next, in FIG. 8, replenishment processing from the coin cassette 92 will be described.

Figure 8:
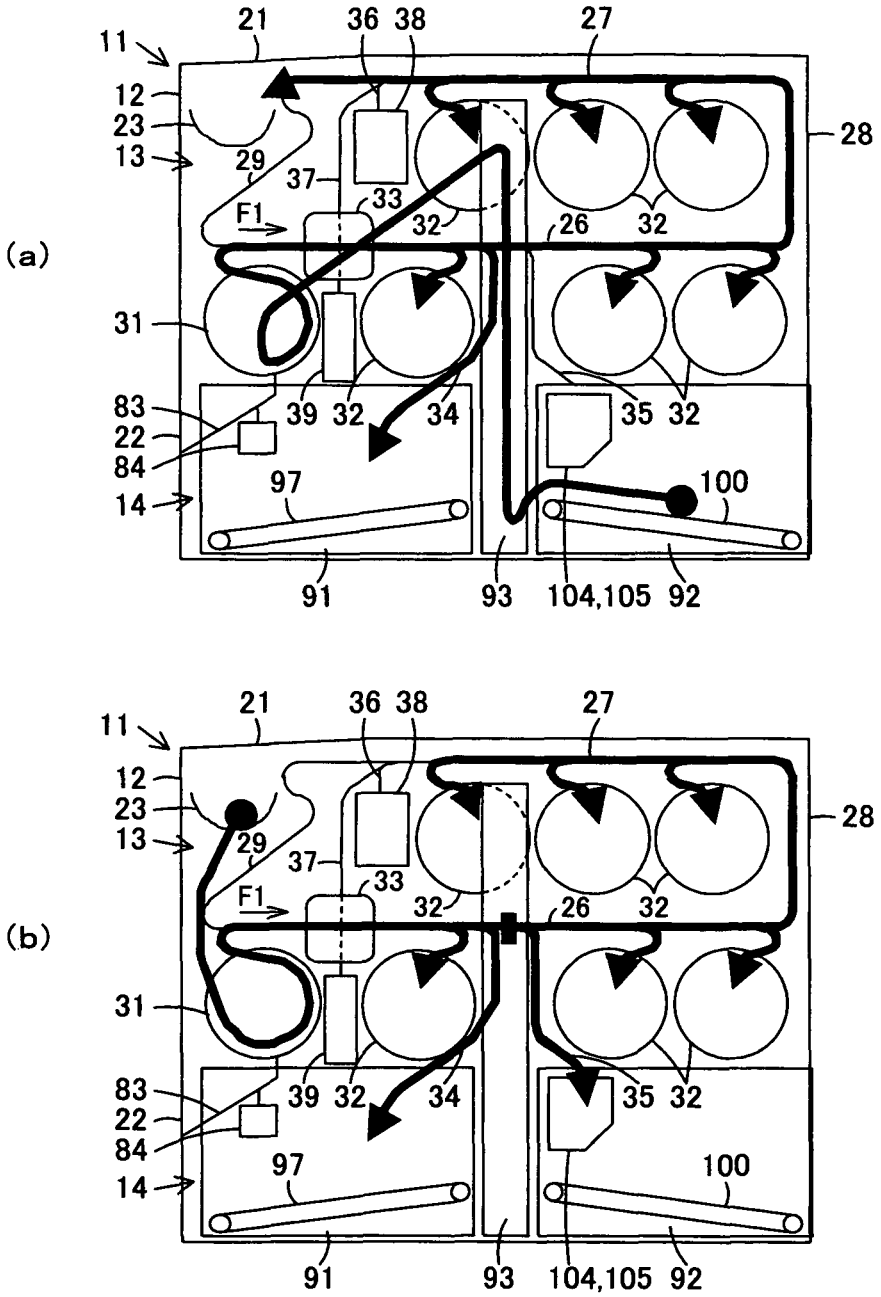
FIG. 8 show replenishment processing from the coin cassette of the same coin handling machine, and FIG. 8(*a*) is an explanatory view showing a coin replenishing operation, and FIG. 8(*b*) is an explanatory view showing a re-recognizing operation for a coin not recognized as a normal coin.

FIG. 8(*a*) shows a coin replenishing operation in the replenishment processing.

The replenishment processing from the coin cassette 92 includes initial replenishment to be performed when no coin is stored in the coin handling machine 11, and mid-process replenishment to be performed when the coin amount in the storing and feeding unit 32 including the overflow stacking unit 91 has decreased.

The belt 100 of the coin cassette 92 rotates to eject coins in the coin cassette 92 to the conveyor 110 of the replenishment transport path 93. The coins are transported upward by the vertical transport unit 109 of the conveyor 110, ejected to the replenishment chute 112 from the upper portion of the vertical transport unit 109, and sent into the depositing and feeding unit 31 through the replenishment chute 112.

Coins are fed out one by one from the depositing and feeding unit 31 into the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted from the depositing and dispensing transport path 25 into the storing and feeding unit 32 storing coins of the corresponding denomination by the sorting member 47 of the storing and feeding unit 32, and stored in the storing and feeding unit 32.

When the number of stored coins in the storing and feeding unit 32 reaches a predetermined number, subsequent coins of the corresponding denomination are regarded as overflowing coins, sorted into the overflow passage 34 by the sorting member 47 of the overflow passage 34, and sent into and stored in the storing space 95 of the overflow stacking unit 91 through the overflow passage 34.

A coin not recognized as a normal coin as a result of recognition by the recognition unit 33 is ejected from the depositing and dispensing transport path 25 to the tray 23.

FIG. 8(*b*) shows a re-recognizing operation for a coin not recognized as a normal coin in replenishment processing.

After transportation processing is completed for all coins fed out from the coin cassette 92, if coins remain in the tray 23, the tray 23 is turned over and the coins are ejected to the depositing and feeding unit 31, coins are fed out one by one from the depositing and feeding unit 31 to the depositing and dispensing transport path 25, and the coins fed out into the depositing and dispensing transport path 25 are transported one by one in the depositing transporting direction F1 by the belt 43, and the coins being transported are re-recognized by the recognition unit 33.

A coin recognized as a normal coin as a result of re-recognition by the recognition unit 33 is sorted from the depositing and dispensing transport path 25 into the storing and feeding unit 32 storing coins of the corresponding denomination by the sorting member 47 of the storing and feeding unit 32, and stored in the storing and feeding unit 32.

A coin which was recognized as a normal coin as a result of re-recognition by the recognition unit 33 but is of a denomination the number of stored coins of which has reached a predetermined number, the coin is regarded as an overflowing coin and sorted into the overflow passage 34 by the sorting member 47 of the overflow passage 34, and sent into and stored in the storing space 95 of the overflow stacking unit 91 through the overflow passage 34.

A coin not recognized as a normal coin as a result of re-recognition by the recognition unit 33 is sorted into the collecting passage 35 by the sorting member 47 of the collecting passage 35, and sent into and stored in the replenishment reject box 105 of the coin cassette 92 through the collecting passage 35.

Next, in FIG. 9, replenishment processing from the inlet/outlet 21 will be described.

Figure 9:
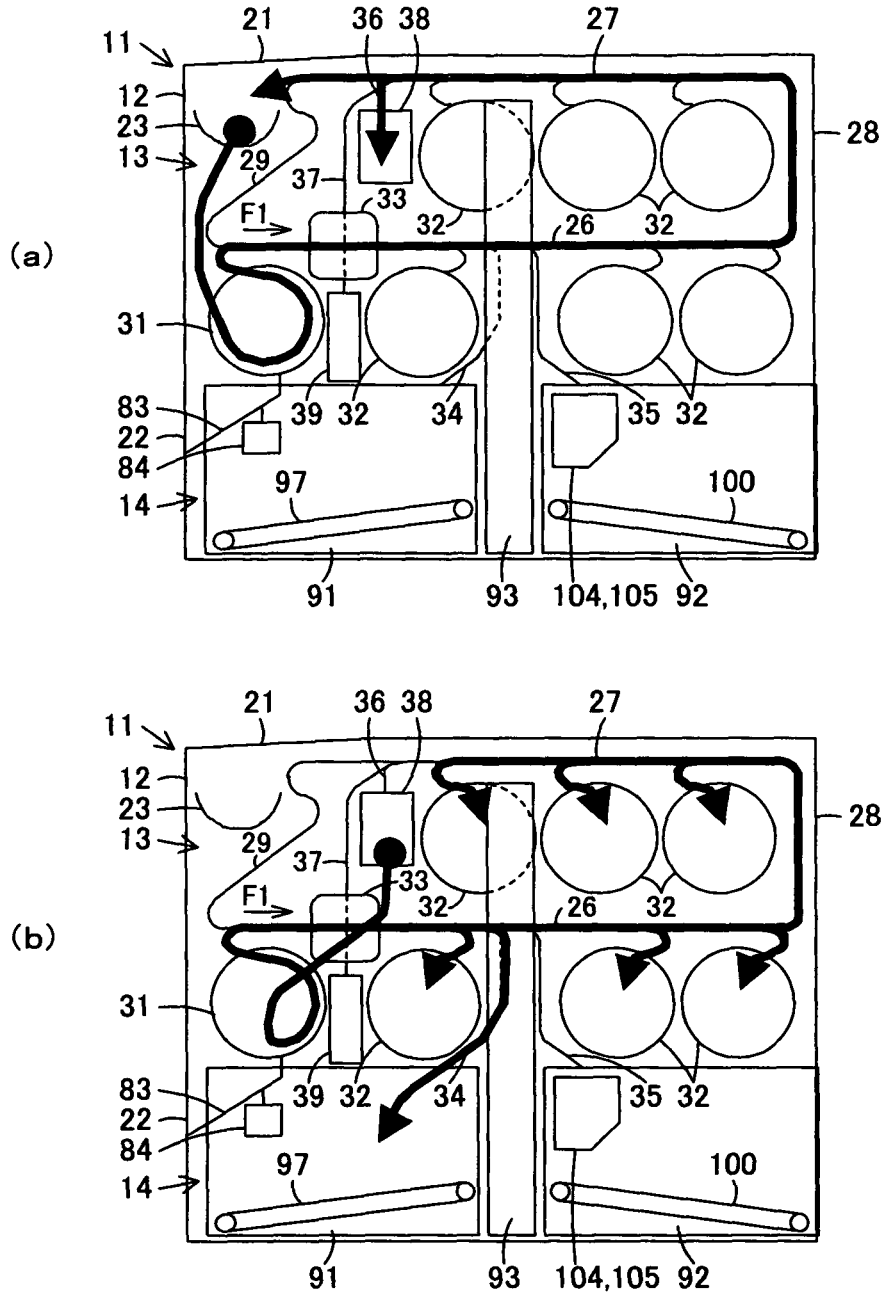
FIG. 9 show replenishment processing from an inlet/outlet of the same coin handling machine, and FIG. 9(*a*) is an explanatory view showing a coin counting and escrowing operation, and FIG. 9(*b*) is an explanatory view showing a coin replenishing operation.

FIG. 9(*a*) shows a coin counting and escrowing operation in replenishment processing.

Coins for replenishment input into the tray 23 from the inlet/outlet 21 on the upper surface of the machine body 12 are ejected to the depositing and feeding unit 31 by turning over of the tray 23. The tray 23 is restored to a posture for receiving and storing coins after being turned over.

Coins received in the depositing and feeding unit 31 are fed out one by one to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted from the depositing and dispensing transport path 25 into the escrow unit 38 by the sorting member 47 of the escrow unit 38, and stored in the escrow unit 38.

A coin not recognized as a normal coin as a result of recognition by the recognition unit 33 passes through the position of the escrow unit 38 and is ejected to the tray 23 restored to a posture for receiving and storing coins from the depositing and dispensing transport path 25, and returned.

Further, FIG. 9(*b*) shows a coin replenishing operation in replenishment processing.

After the counting and escrowing operation is finished for all input coins, when a coin storing command is issued by an operation on the operation unit, coins in the escrow unit 38 are ejected to the depositing and feeding unit 31. Coins are fed out one by one from the depositing and feeding unit 31 to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted from the depositing and dispensing transport path 25 into the storing and feeding unit 32 storing coins of the corresponding denomination by the sorting member 47 of the storing and feeding unit 32, and stored in the storing and feeding unit 32.

When the number of stored coins in the storing and feeding unit 32 reaches a predetermined number, subsequent coins of the corresponding denomination are regarded as overflowing coins and sorted into the overflow passage 34 by the sorting member 47 of the overflow passage 34, and sent into and stored in the storing space 95 of the overflow stacking unit 91 through the overflow passage 34.

A coin not recognized as a normal coin as a result of recognition by the recognition unit 33 is sorted into the overflow passage 34 by the sorting member 47 of the overflow passage 34, and sent into and stored in the operational reject box 102 of the overflow stacking unit 91 through the overflow passage 34.

Next, in FIG. 10, collection processing of the storing and feeding unit 32 will be described.

Figure 10:
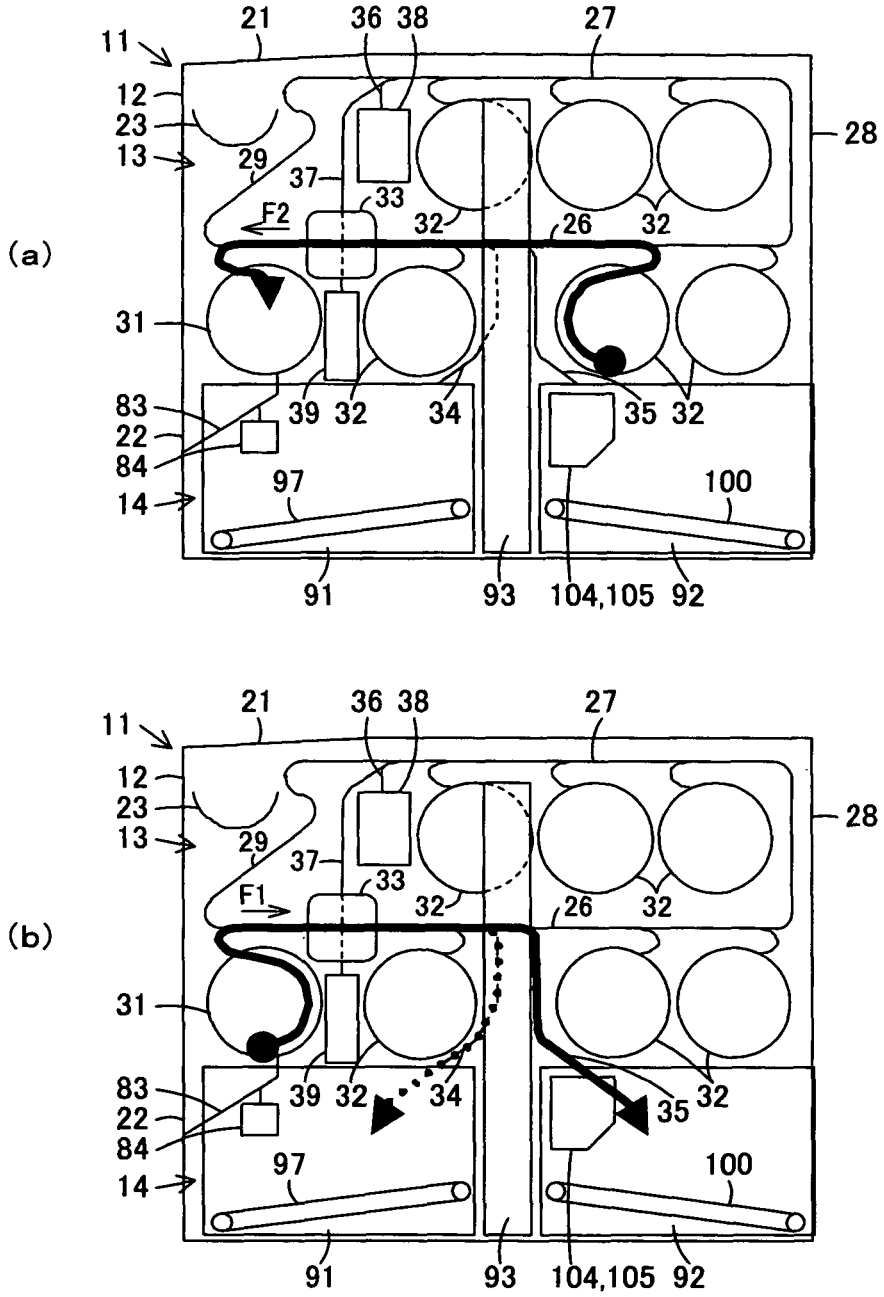
FIG. 10 show collection processing from a storing and feeding unit of the same coin handling machine, and FIG. 10(*a*) is an explanatory view showing a coin moving operation from the storing and feeding unit to the depositing and feeding unit, and FIG. 9(*b*) is an explanatory view showing a coin collecting operation from the depositing and feeding unit to the coin cassette.

FIG. 10(*a*) shows a coin moving operation from the storing and feeding unit 32 to the depositing and feeding unit 31.

When a collecting command is issued by an operation on the operation unit, coins in a certain storing and feeding unit 32 are fed out one by one to the depositing and dispensing transport path 25, and the coins fed out into the depositing and dispensing transport path 25 are transported one by one in the dispensing transporting direction F2 by the belt 43, and the coins being transported are recognized by the recognition unit 33 and then sorted into and stored in the depositing and feeding unit 31 by the sorting member 47 of the depositing and feeding unit 31.

FIG. 10(*b*) shows a coin collecting operation from the depositing and feeding unit 31 to the coin cassette 92.

Coins are fed out one by one from the depositing and feeding unit 31 to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted into the collecting passage 35 by the sorting member 47 of the collecting passage 35, and sent into and collected in the coin cassette 92 through the collecting passage 35.

A coin not recognized as a normal coin as a result of recognition by the recognition unit 33 is sorted into the overflow passage 34 by the sorting member 47 of the overflow passage 34, and sent into and stored in the operational reject box 102 of the overflow stacking unit 91 through the overflow passage 34.

Then, such collecting operation is performed for all storing and feeding units 32 in order.

Next, in FIG. 11, collection processing from the overflow stacking unit 91 will be described.

Figure 11:
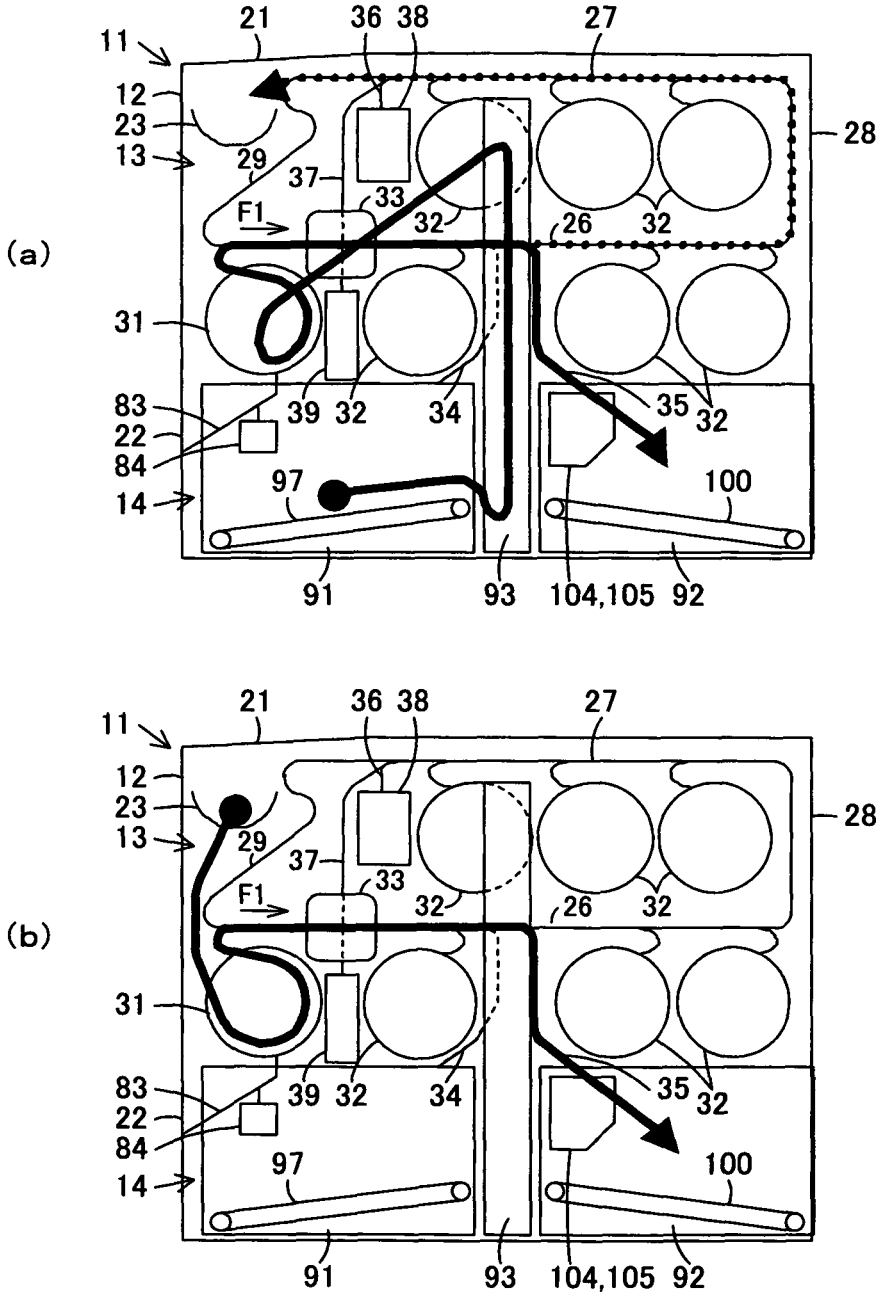
FIG. 11 show collection processing from the overflow stacking unit of the same coin handling machine, and FIG. 11(*a*) is an explanatory view showing a coin collecting operation from the overflow stacking unit to the coin cassette, and FIG. 11(*b*) is an explanatory view showing a re-recognizing operation for a coin not recognized as a normal coin.

FIG. 11(*a*) shows a coin collecting operation from the overflow stacking unit 91 to the coin cassette 92.

The belt 97 of the overflow stacking unit 91 rotates to eject coins in the overflow stacking unit 91 onto the conveyor 110 of the replenishment transport path 93 from the rear surface of the overflow stacking unit 91. Coins are transported upward by the vertical transport unit 109 of the conveyor 110, ejected from the upper portion of the vertical transport unit 109 to the replenishment chute 112, and sent into the depositing and feeding unit 31 through the replenishment chute 112.

Coins are fed out one by one from the depositing and feeding unit 31 to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted into the collecting passage 35 by the sorting member 47 of the collecting passage 35, and sent into and collected in the coin cassette 92 through the collecting passage 35.

A coin not recognized as a normal coin as a result of recognition by the recognition unit 33 is ejected to the tray 23 from the depositing and dispensing transport path 25.

FIG. 11(*b*) shows a re-recognizing operation for coins not recognized as normal coins.

After transporting processing for all coins fed out from the overflow stacking unit 91 is completed, when coins not recognized as normal coins remain in the tray 23, the coins are ejected to the depositing and feeding unit 31 by turning over the tray 23, and the coins are fed out one by one from the depositing and feeding unit 31 to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted into the collecting passage 35 by the sorting member 47 of the collecting passage 35 and sent into and collected in the coin cassette 92 through the collecting passage 35.

A coin not recognized as a normal coin as a result of recognition by the recognition unit 33 is sorted into the overflow passage 34 by the sorting member 47 of the overflow passage 34, and sent into and stored in the operational reject box 102 of the overflow stacking unit 91 through the overflow passage 34.

Next, in FIG. 12, verification processing for verifying coins stored in each storing and feeding unit 32 will be described.

Figure 12:
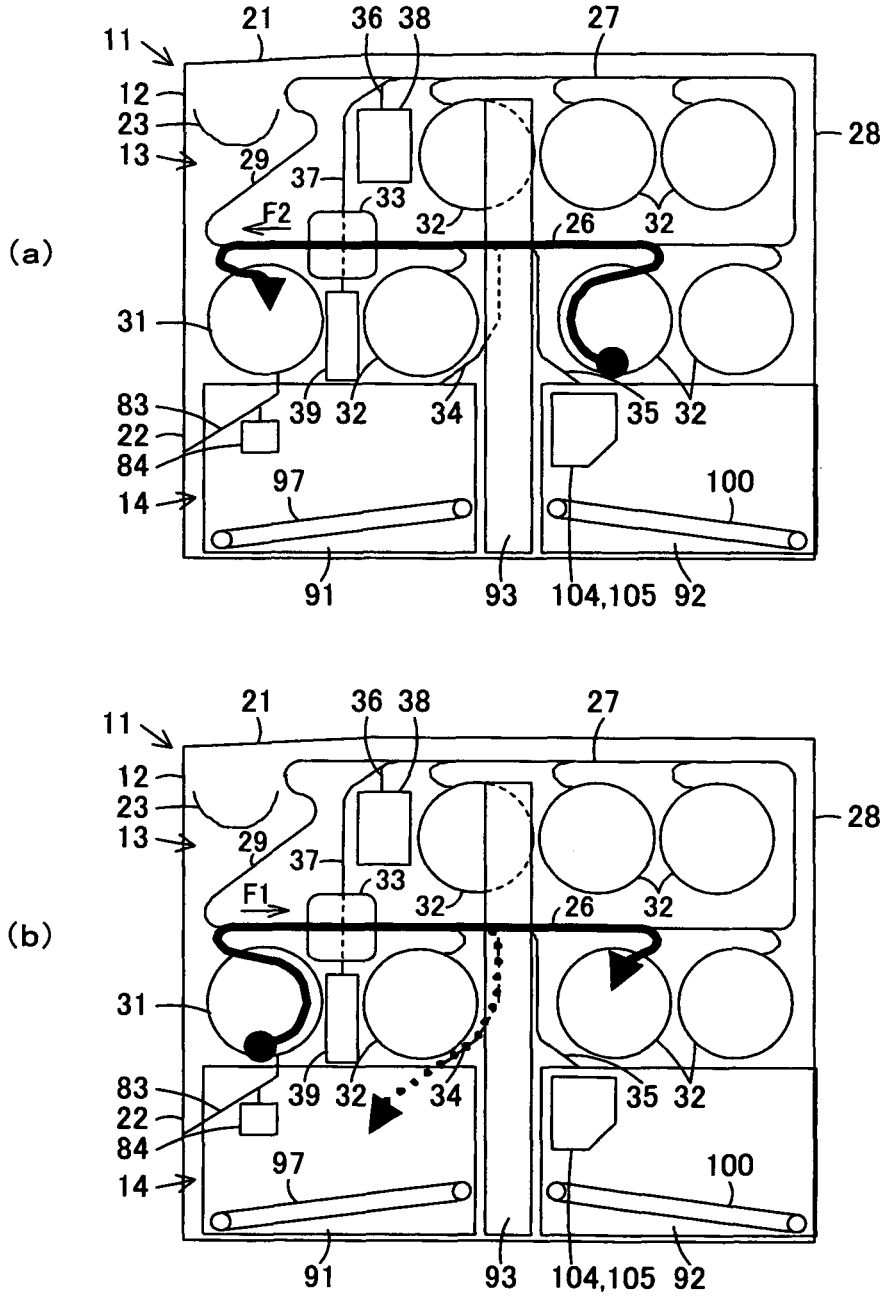
FIG. 12 show verification processing of the storing and feeding units of the same coin handling machine, and FIG. 12(*a*) is an explanatory view showing a coin moving operation from the storing and feeding unit to the depositing and feeding unit, and FIG. 12(*b*) is an explanatory view showing a coin returning operation from the depositing and feeding unit to the storing and feeding unit.

FIG. 12(*a*) shows a coin counting and escrowing operation from the storing and feeding unit 32 to the depositing and feeding unit 31 in the verification processing.

When a verifying command is received, coins are fed out one by one from any one of the storing and feeding units 32 to the depositing and dispensing transport path 25, and the coins fed out into the depositing and dispensing transport path 25 are transported one by one in the dispensing transporting direction F2 by the belt 43, and the coins being transported are recognized by the recognition unit 33.

Coins recognized by the recognition unit 33 are sorted into and stored in the depositing and feeding unit 31 from the depositing and dispensing transport path 25 by the sorting member 47 of the depositing and feeding unit 31.

Moreover, FIG. 12(*b*) shows a coin returning operation from the depositing and feeding unit 31 to the storing and feeding unit 32 in the verification processing.

After all coins in the storing and feeding unit 32 to be verified are recognized and moved to the depositing and feeding unit 31, coins in the depositing and feeding unit 31 are fed out one by one to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted from the depositing and dispensing transport path 25 into the storing and feeding unit 32 storing coins of the corresponding denomination by the sorting member 47 of the storing and feeding unit 32, and stored in the storing and feeding unit 32.

A coin not recognized as a normal coin as a result of recognition by the recognition unit 33 is sorted into the overflow passage 34 by the sorting member 47 of the overflow passage 34, and sent into and stored in the operational reject box 102 of the overflow stacking unit 91 through the overflow passage 34.

Then, after the coin recognition and movement from the storing and feeding unit 32 to the depositing and feeding unit 31, the coin recognition and movement from the depositing and feeding unit 31 to the original storing and feeding unit 32 are performed in order for all storing and feeding units 32 to verify the coins stored in all storing and feeding units 32 in the machine body 12.

Next, in FIG. 13, verification processing for verifying coins stored in the overflow stacking unit 91 will be described.

Verification of coins stored in the overflow stacking unit 91 can be performed only when it is confirmed that no coins are stored in the coin cassette 92, and cannot be performed when coins are stored in the coin cassette 92.

Figure 13:
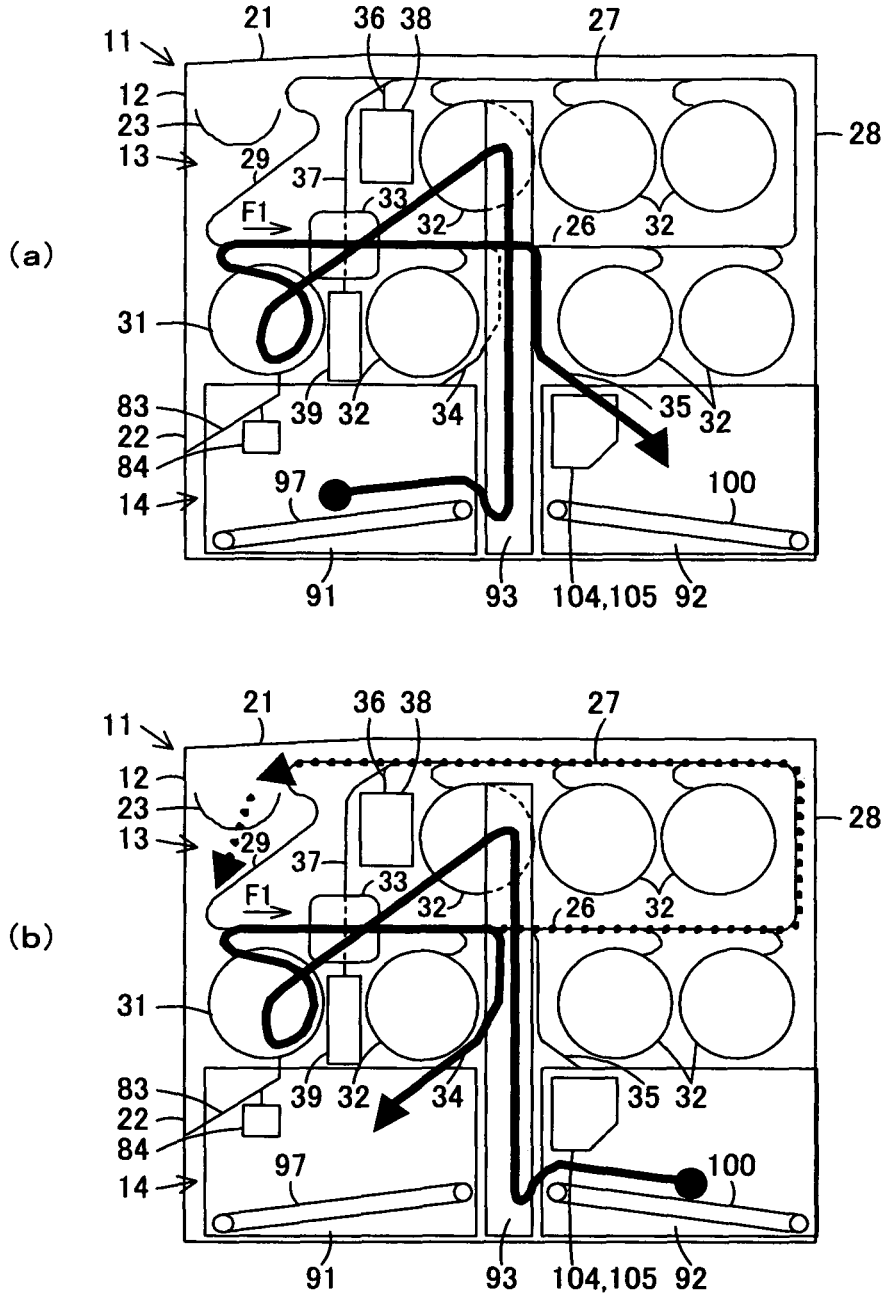
FIG. 13 show verification processing of the overflow stacking unit of the same coin handling machine, and FIG. 13(*a*) is an explanatory view showing a coin moving operation from the overflow stacking unit to the coin cassette, and FIG. 13(*b*) is an explanatory view showing a coin returning operation from the coin cassette to the overflow stacking unit.

FIG. 13(*a*) shows a coin moving operation from the overflow stacking unit 91 to the coin cassette 92 in the verification processing.

The belt 97 of the overflow stacking unit 91 rotates to eject coins in the overflow stacking unit 91 onto the conveyor 110 of the replenishment transport path 93. Coins are transported upward by the vertical transport unit 109 of the conveyor 110, ejected from the upper portion of the vertical conveying portion 109 to the replenishment chute 112, and sent into the depositing and feeding unit 31 through the replenishment chute 112.

The coins are fed out one by one from the depositing and feeding unit 31 to the depositing and dispensing transport path 25, and the coins fed out into the depositing and dispensing transport path 25 are transported one by one in the depositing transporting direction F1 by the belt 43, and the coins being transported are recognized by the recognition unit 33 and then sorted into the collecting passage 35 by the sorting member 47 of the collecting passage 35 and sent into and stored in the coin cassette 92 through the collecting passage 35.

Further, FIG. 13(*b*) shows a coin returning operation from the coin cassette 92 to the overflow stacking unit 91.

After the moving operation for the coins fed out from the overflow stacking unit 91, the belt 100 of the coin cassette 92 rotates to eject the coins in the coin cassette 92 onto the conveyor 110 of the replenishment transport path 93. The coins are transported upward by the vertical transport unit 109 of the conveyor 110, ejected from the upper portion of the vertical transport unit 109 to the replenishment chute 112, and sent into the depositing feeding unit 31 through the replenishment chute 112.

Coins are fed out one by one from the depositing and feeding unit 31 to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted into the overflow passage 34 by the sorting member 47 of the overflow passage 34, and sent into and stored in the storing space 95 of the overflow stacking unit 91 through the overflow passage 34.

A coin not recognized as a normal coin as a result of recognition by the recognition unit 33 is ejected from the depositing and dispensing transport path 25 to the tray 23, and after a coin returning operation from the coin cassette 92 is finished, a re-recognizing operation for re-recognizing the coin not recognized as a normal coin is performed. Specifically, coins are ejected to the depositing and feeding unit 31 by turning over the tray 23, the coins are fed out one by one from the depositing and feeding unit 31 to the depositing and dispensing transport path 25, and the coins fed out into the depositing and dispensing transport path 25 are transported one by one in the depositing transporting direction F1 by the belt 43, and the coins being transported are re-recognized by the recognition unit 33. A coin recognized as a normal coin as a result of re-recognition by the recognition unit 33 is sorted into the overflow passage 34 by the sorting member 47 of the overflow passage 34, and sent into and stored in the storing space 95 of the overflow stacking unit 91 through the overflow passage 34. A coin not recognized as a normal coin as a result of re-recognition by the recognition unit 33 is sorted into the overflow passage 34 by the sorting member 47 of the overflow passage 34 and sent into and stored in the operational reject box 102 of the overflow stacking unit 91 through the overflow passage 34.

Moreover, in each processing described above, the belt 43 of the depositing and dispensing transport path 25 is rotatable in directions opposite to the depositing transporting direction F1 and the dispensing transporting direction F2, so that when coins being transported in the depositing transporting direction F1 or the dispensing transporting direction F2 the depositing and dispensing transport path 25 jam, a jam eliminating operation can be performed to feed out jamming coins and return them to the original state by rotating the belt 43 reversely. Then, after the jamming coins are fed out and returned to their original normal state, a retry operation for retrying the feeding operation can be performed again.

In the coin handling machine 11 thus configured, each of the depositing and feeding unit 31 and the plurality of storing and feeding units 32 uses a configuration including a rotary disk 60 which rotates at a position inclined at a predetermined angle with respect to the horizontal direction and a hopper 61 which stores coins in an unaligned state on the surface side of the rotary disk 60 so as to receive coins from the depositing and dispensing transport path 25 and feed out coins one by one to the depositing and dispensing transport path 25 by rotation of the rotary disk 60, so that while the coin handling machine 11 is capable of handling a large amount of coins at a time, the coin handling machine 11 has a transportation structure which can be simplified, reduced in size and cost, and can reduce the occurrence of trouble such as coin jams, replenish coins from the replenishing and collecting unit 14 to the depositing and dispensing unit 13, dispense a large amount of coins, store and collect coins sent from the depositing and dispensing unit 13, and handle a large amount of coins as well.

The escrow unit 38 is positioned higher than the depositing and feeding unit 31, and required only to eject coins to the depositing and feeding unit 31 in response to a coin storing command, so that the configuration of the escrow unit 38 can be simplified.

The replenishing and collecting unit 14 includes the overflow stacking unit 91 fixedly disposed on the machine body 12 and the coin cassette 92 removably disposed on the machine body 12, and the overflow stacking unit 91 can be used for storing coins of a denomination of which the storing and feeding unit 32 has become full and replenishing the stored coins, the coin cassette 92 can be used for replenishing coins from the outside and collecting coins from the inside of the machine body 12, and these can be adapted as appropriate.

The overflow stacking unit 91 and the coin cassette 92 of the replenishing and collecting unit 14 store coins in an unaligned state and are capable of feeding out coins to the replenishment transport path 93 by rotations of the belts 97 and 100 constituting the bottom portions of the spaces for storing coins, so that a large amount of coins can be handled.

Further, in the replenishment transport path 93, coins fed out from the overflow stacking unit 91 and the coin cassette 92 are received in the horizontal transport unit 108 and transported upward by the vertical transport unit 109, so that the coins can be dropped and sent into the depositing and feeding unit 31, so that the transportation structure can be simplified.

The vertical transport unit 109 of the replenishment transport path 93 positioned on the side portion of the inlet/outlet 13 is capable of leaving a space between the vertical transport unit 109 and the inlet/outlet 13, so that at the occurrence of trouble, the inlet/outlet 13 can be easily dealt with.

Moreover, the overflow stacking unit 91 includes the operational reject box 102 which stores rejected coins at the time of the depositing and dispensing operation and the replenishment reject box 103 which stores rejected coins at the time of replenishment, these operational reject box 102 and replenishment reject box 103 are separable from the machine body 12, and the coin cassette 92 includes the operational reject box 104 which stores rejected coins at the time of the depositing and dispensing operation and the replenishment reject box 105 which stores rejected coins at the time of replenishment, these operational reject box 104 and replenishment reject box 105 are removably attached to the machine body 12, integrally with the coin cassette 92, and the rejected coins can be managed separately at the time of depositing and dispensing operation and replenishment, and a method of handling rejected coins can be freely selected.

Next, a second embodiment is shown in FIG. 14 to FIG. 20.

The coin handling machine 11 of the second embodiment is different from the coin handling machine 11 of the first embodiment only in a part of the layout of the internal configuration, and therefore, the difference from the first embodiment will be mainly described, and components having the same functions as those in the first embodiment are designated by the same reference numerals and description thereof will be omitted.

Figure 14:
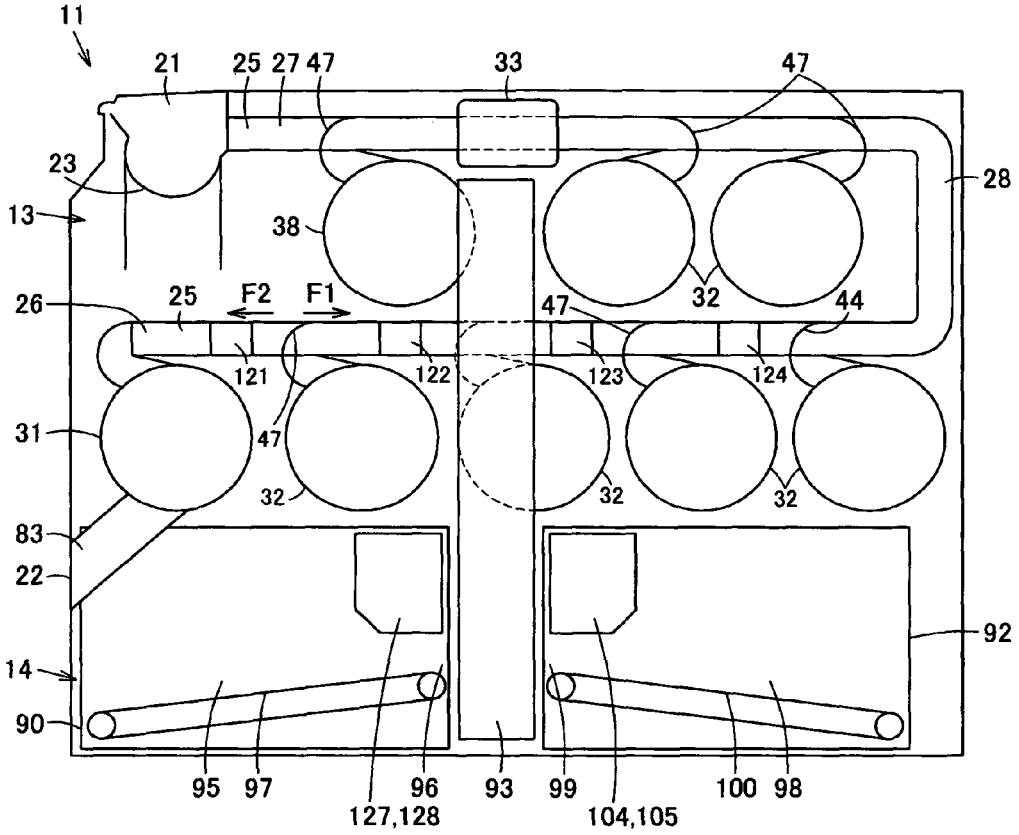
FIG. 14 is a side view of an internal structure of a coin handling machine showing a second embodiment of the present invention.

As shown in FIG. 14, the depositing and dispensing transport path 25 includes a first transport path portion 26 provided substantially horizontally in the front-rear direction of the machine body 12, a second transport path portion 27 provided substantially horizontally in the front-rear direction of the machine body 12 above the first transport path portion 26, and a third transport path portion 28 connecting the rear portions of the first transport path portion 26 and the second transport path portion 27 in the up-down direction. In this depositing and dispensing transport path 25, a belt 43 which transports coins in the depositing and dispensing transport path 25 is disposed although this is not shown. Here, the direction of transporting coins from the second transport path portion 27 to the third transport path portion 28 and the first transport path portion 26 is referred to as a depositing transporting direction F1 as a first transporting direction, on the other hand, the direction of transporting coins from the first transport path portion 26 to the third transport path portion 28 and the second transport path portion 27 is referred to as a dispensing transporting direction F2 as a second transporting direction.

Moreover, a depositing and feeding unit 31 is connected to and disposed on the front side of the first transport path portion 26 of the depositing and dispensing transport path 25, and a plurality of denomination-specific storing and feeding units 32 are connected to and disposed on the rear side of the depositing and feeding unit 31 of the first transport path portion 26 and the second transport path portion 27, an escrow unit 38 is connected to and disposed on the side anterior to the storing and feeding units 32 of the second transport path portion 27, and the front side of the second transport path portion 27 is connected to the inlet/outlet 21.

The depositing and feeding unit 31 is able to divert and receive coins being transported in the depositing transporting direction F1 inside the depositing and dispensing transport path 25, and is able to feed out the coins in the dispensing transporting direction F2 to the depositing and dispensing transport path 25. The plurality of storing and feeding units 32 is able to divert and receive coins being transported in the depositing transporting direction F1 inside the depositing and dispensing transport path 25, and is able to feed out coins in the dispensing transporting direction F2 to the depositing and dispensing transport path 25. The escrow unit 38 is able to divert and receive coins being transported in the dispensing transporting direction F2 inside the depositing and dispensing transport path 25, and is able to feed out coins in the depositing transporting direction F1 to the depositing and dispensing transport path 25.

These depositing and feeding unit 31, the respective storing and feeding units 32, and the escrow unit 38 include a rotary disk 60, a hopper 61, and a delivery disk 62, etc., and enable to store and feed out coins as described in the first embodiment. Only in the depositing and feeding unit 31, the discharge port 76 and the discharge gate 77, etc., of the hopper 61 have a foreign material discharge function.

At the connecting portions between the depositing and feeding transport path 25 and the respective storing and feeding units 32, and between the depositing and feeding transport path 25 and the escrow unit 38, sorting members 47 which selectively sort coins depending on whether the coins are input or output between the respective storing and feeding units 32 and escrow unit 38 and the depositing and dispensing transport path 25 or the coins being transported by the belt 43 are allowed to pass to the downstream side in the transporting direction, are disposed.

Further, in the second transport path portion 27 of the depositing and dispensing transport path 25, between the escrow unit 38 and the storing and feeding units 32, the recognition unit 33 which selectively recognizes as appropriate at least denominations, authenticity, and fitness, etc., of coins being transported is disposed.

In the first transport path portion 26 of the depositing and dispensing transport path 25, an overflowing coin diverting unit 121 which diverts coins to the overflow stacking unit 91 is provided between the depositing and feeding unit 31 and the forefront storing and feeding unit 32, a forgotten-to-be-taken coin diverting unit 122 which diverts coins to the overflow stacking unit 91 side is provided between the forefront storing and feeding unit 32 and the second storing and feeding unit 32 from the forefront unit, a rejected coin diverting unit 123 which diverts coins to the coin cassette 92 side is provided between the second and third storing and feeding units 32 from the forefront unit, and a collected coin diverting unit 124 which diverts coins into the coin cassette 92 is provided between the third and fourth storing and feeding units 32 from the forefront unit.

Figure 15:
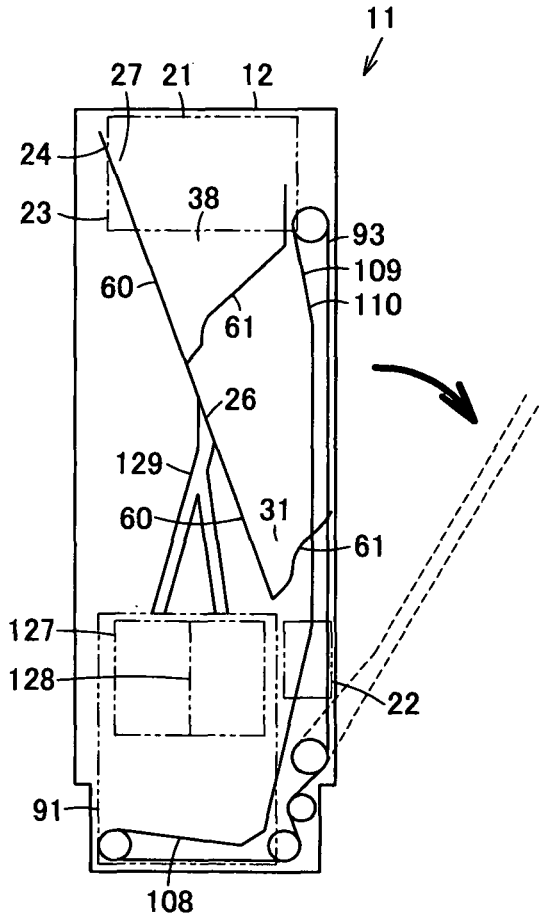
FIG. 15 is a front view showing the internal structure of the same coin handling machine.

Moreover, as shown in FIG. 14 and FIG. 15, the overflow stacking unit 91 is able to store coins diverted by the overflowing coin diverting unit 121 from the depositing and dispensing transport path 25, and is able to feed out coins to the replenishment transport path 93 by the belt 97. This overflow stacking unit 91 includes a forgotten-to-be-taken box 127 to store forgotten-to-be-taken coins and an auxiliary box 128 usable for storing arbitrarily set predetermined coins. Coins diverted by the forgotten-to-be-taken coin diverting unit 122 from the depositing and dispensing transport path 25 are guided to and stored in either the forgotten-to-be-taken box 127 or the auxiliary box 128 by a forgotten-to-be-taken coin passage 129 and a switching mechanism not shown provided in the forgotten-to-be-taken coin passage 129. These forgotten-to-be-taken box 127 and the auxiliary box 128 are configured as separation types removable individually from the machine body 12.

The coin cassette 92 is able to store coins diverted by the collected coin diverting unit 124 from the depositing and dispensing transport path 25, and is able to feed out coins to the replenishment transport path 93 by the belt 100. The coin cassette 92 includes an operational reject box 104 as a reject box for storing rejected coins not recognized as normal coins by the recognition unit 33 at the time of depositing and dispensing operation, and a replenishment reject box 105 as a reject box for storing coins not recognized as normal coins by the recognition unit 33 of the depositing and dispensing unit 13 at the time of replenishment. Coins diverted by the rejected coin diverting unit 123 from the depositing and dispensing transport path 25 are guided to and stored in either the operational reject box 104 or the replenishment reject box 105 by a passage and a switching mechanism provided in the passage which are not shown. These operational reject box 104 and replenishment reject box 105 are configured as integral types removably attached to the machine body 12, integrally with the coin cassette 92.

The replenishment transport path 93 includes a conveyor 110 which receives coins fed out from the overflow stacking unit 91 and the coin cassette 92, and transports the coins to the escrow unit 38.

Next, operation and effect of the second embodiment will be described.

First, in FIG. 16, deposit processing will be described.

Figure 16:
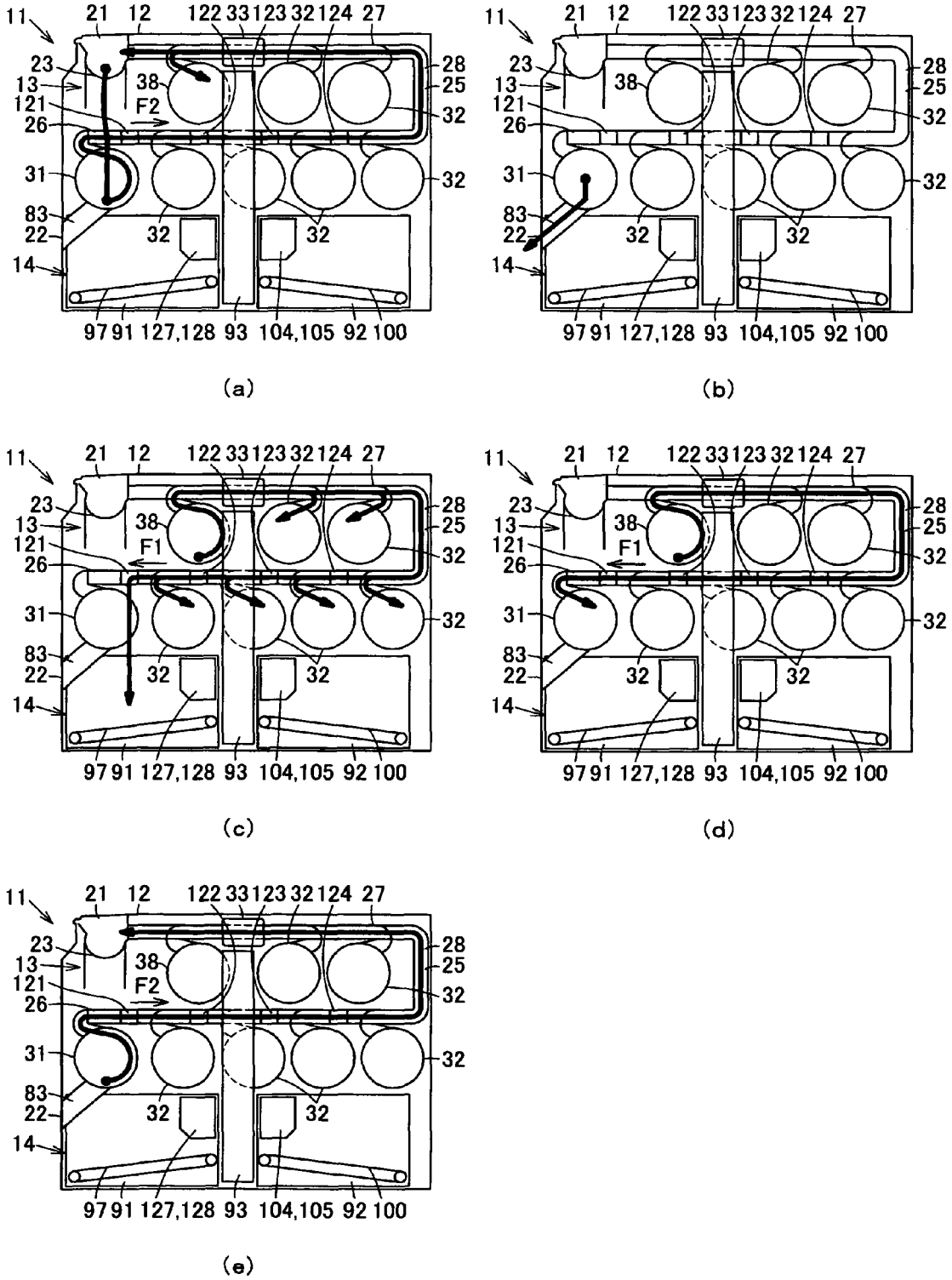
FIG. 16 show deposit processing of the same coin handling machine, and FIG. 16(*a*) is an explanatory view showing a deposited coin counting and escrowing operation, FIG. 16(*b*) is an explanatory view showing a foreign material returning operation, FIG. 16(*c*) is an explanatory view showing an escrowed coin storing operation, FIG. 16(*d*) is an explanatory view showing an escrowed coin returning operation, and FIG. 16(*e*) is an explanatory view showing a returning operation following the returning operation of FIG. 16(*d*)

FIG. 16(*a*) shows a deposited coin counting and escrowing operation in deposit processing.

Coins input into the tray 23 from the inlet/outlet 21 of the machine body 12 are ejected downward by turning over of the tray 23, and received in the depositing and feeding unit 31. The tray 23 is restored to a posture for receiving and storing coins after being turned over.

The coins received in the depositing and feeding unit 31 are fed out one by one to the depositing and dispensing transport path 25, and the coins fed out into the depositing and dispensing transport path 25 are transported one by one in the dispensing transporting direction F2 by the belt 43, and the coins being transported are recognized by the recognition unit 33.

A coin recognized as a normal coin as a result of recognition by the recognition unit 33 is sorted from the depositing and dispensing transport path 25 to the escrow unit 38 by the diverting member 47 of the escrow unit 38, and stored in the escrow unit 38.

A coin not recognized as a normal coin as a result of recognition by the recognition unit 33 passes through the position of the escrow unit 38 and is ejected to the tray 23 restored to the posture for receiving and storing coins from the depositing and dispensing transport path 25, and returned.

Further, FIG. 16(*b*) shows a foreign material returning operation in deposit processing.

Based on detection by a sensor not shown which detects coins in the depositing and feeding unit 31, when it is judged that a foreign material remains which is not fed out from the depositing and feeding unit 31, or after all coins are completely fed out from the depositing and feeding unit 31, the discharge gate 77 of the hopper 61 of the depositing and feeding unit 31 is opened, and the foreign material such as a clip, piece of paper, a deformed coin or the like is ejected to the foreign material chute 83 below, and returned to the foreign material returning port 22.

Further, FIG. 16(*c*) shows an escrowed coin storing operation in deposit processing.

After the counting and escrowing operation is finished for all input coins, when a coin storing command is issued by an operation on the operation unit, coins in the escrow unit 38 are fed out one by one to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted from the depositing and dispensing transport path 25, by the sorting member 47 of the storing and feeding unit 32, into the storing and feeding unit 32 storing coins of the corresponding denomination, and stored in the storing and feeding unit 32.

When the number of stored coins in the storing and feeding unit 32 reaches a predetermined number, subsequent coins of the corresponding denomination are regarded as overflowing coins, diverted by the overflowing coin diverting unit 121, and sent into and stored in the overflow stacking unit 91.

A coin not recognized as a normal coin as a result of recognition by the recognition unit 33 is diverted by the overflowing coin diverting unit 121 and sent into and stored in the overflow stacking unit 91, or diverted by the rejected coin diverting unit 123 and sent into and stored in the operational reject box 104 of the coin cassette 92.

Moreover, FIG. 16(*d*) and FIG. 16(*e*) show an escrowed coin returning operation in deposit processing.

As shown in FIG. 16(*d*), after the counting and escrowing operation is finished for all input coins, when a coin returning command is issued by an operation on the operation unit, coins in the escrow unit 38 are fed out one by one to the depositing and dispensing transport path 25, and the coins fed out into the depositing and dispensing transport path 25 are transported one by one in the depositing transporting direction F1 by the belt 43, and stored in the depositing and feeding unit 31.

Subsequently, as shown in FIG. 16(*e*), the coins are fed out one by one from the depositing and feeding unit 31 to the depositing and dispensing transport path 25, and the coins fed out into the depositing and dispensing transport path 25 are transported one by one in the dispensing transporting direction F2 by the belt 43, ejected to the tray 23 of the inlet/outlet 21, and returned.

Next, in FIG. 17, dispensing processing will be described.

Figure 17:
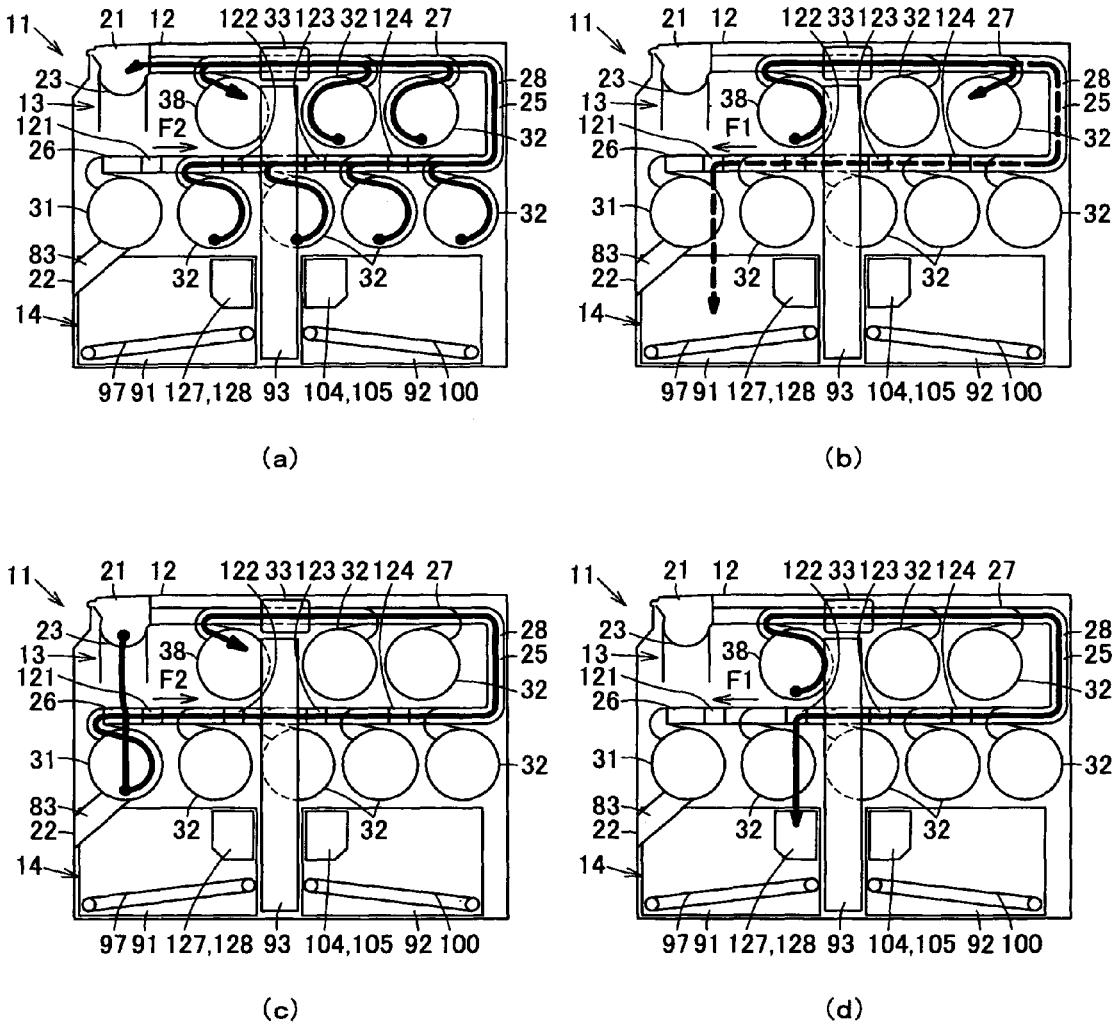
FIG. 17 show dispensing processing of the same coin handling machine, and FIG. 17(*a*) is an explanatory view showing a coin counting and dispensing operation, FIG. 17(*b*) is an explanatory view showing a returning operation for a coin not recognized as a normal coin, FIG. 17(*c*) is an explanatory view showing a collecting operation for a coin forgotten to be taken, and FIG. 17(*d*) is an explanatory view showing a collecting operation for a coin forgotten to be taken, following FIG. 17(*c*)

FIG. 17(*a*) shows a coin counting and dispensing operation in dispensing processing.

When a coin dispensing command including a denomination and a number of coins to be dispensed, or an amount of money to be dispensed is received according to an operation on the operation unit, coins in the corresponding storing and feeding unit 32 are fed out one by one to the depositing and dispensing transport path 25, and the coins fed out into the depositing and dispensing transport path 25 are transported one by one in the dispensing transporting direction F2 by the belt 43, and the coins being transported are recognized by the recognition unit 33.

A coin recognized as a normal coin as a result of recognition by the recognition unit 33 is ejected to the tray 23 of the inlet/outlet 21 from the depositing and dispensing transport path 25.

A coin not recognized as a normal coin as a result of recognition by the recognition unit 33 is sorted into and stored in the escrow unit 38 from the depositing and dispensing transport path 25 by the sorting member 47 of the escrow unit 38. The denomination of the coin not recognized as a normal coin can be known from a dispensing timing from the storing and feeding unit 32 and a timing at which the coin reaches the recognition unit 33 by being transported by the belt 43, so that one coin is additionally dispensed from the storing and feeding unit 32 of the corresponding denomination.

Then, coins to be dispensed are dispensed to the tray 23 of the inlet/outlet 21.

Further, FIG. 17(*b*) shows a returning operation for a coin not recognized as a normal coin in dispensing processing.

From the escrow unit 38 storing coins not recognized as normal coins, coins in the escrow units 38 are fed out one by one to the depositing and dispensing transport path 25, and coins fed out into the depositing and dispensing transport path 25 are transported one by one in the depositing transporting direction F1 by the belt 43, and the coins being transported are re-recognized by the recognition unit 33.

A coin recognized as a normal coin as a result of re-recognition by the recognition unit 33 is sorted from the depositing and dispensing transport path 25, by the sorting member 47 of the storing and feeding unit 32, into the storing and feeding unit 32 storing coins of the corresponding denomination, and stored in the storing and feeding unit 32.

A coin not recognized as a normal coin as a result of re-recognition by the recognition unit 33 is diverted by the overflowing coin diverting unit 121 and sent into and stored in the overflow stacking unit 91.

Moreover, FIG. 17(*c*) and FIG. 17(*d*) show a forgotten-to-be-taken coin collecting operation in dispensing processing.

As shown in FIG. 17(*c*), when a sensor not shown detects that coins are not taken out even after a predetermined time elapses since the dispensing of the coins to be dispensed to the tray 23 of the inlet/outlet 21, it is judged that the coins have been forgotten to be taken, the coins are ejected to the depositing and feeding unit 31 by turning over the tray 23, the coins received in the depositing and feeding unit 31 are fed out one by one to the depositing and dispensing transport path 25, and the coins fed out into the depositing and dispensing transport path 25 are transported one by one in the dispensing transporting direction F2 by the belt 43, and the coins being transported are recognized by the recognition unit 33 and sorted into and stored in the escrow unit 38 from the depositing and dispensing transport path 25 by the sorting member 47 of the escrow unit 38.

Subsequently, as shown in FIG. 17(*d*), coins are fed out one by one from the escrow unit 38 to the depositing and dispensing transport path 25, and the coins fed out into the depositing and transport path 25 are transported one by one in the depositing transporting direction F1 by the belt 43, and the coins being transported are diverted by the forgotten-to-be-taken coin diverting unit 122 and collected in the forgotten-to-be-taken box 127.

Next, in FIG. 18, replenishment processing will be described.

Figure 18:
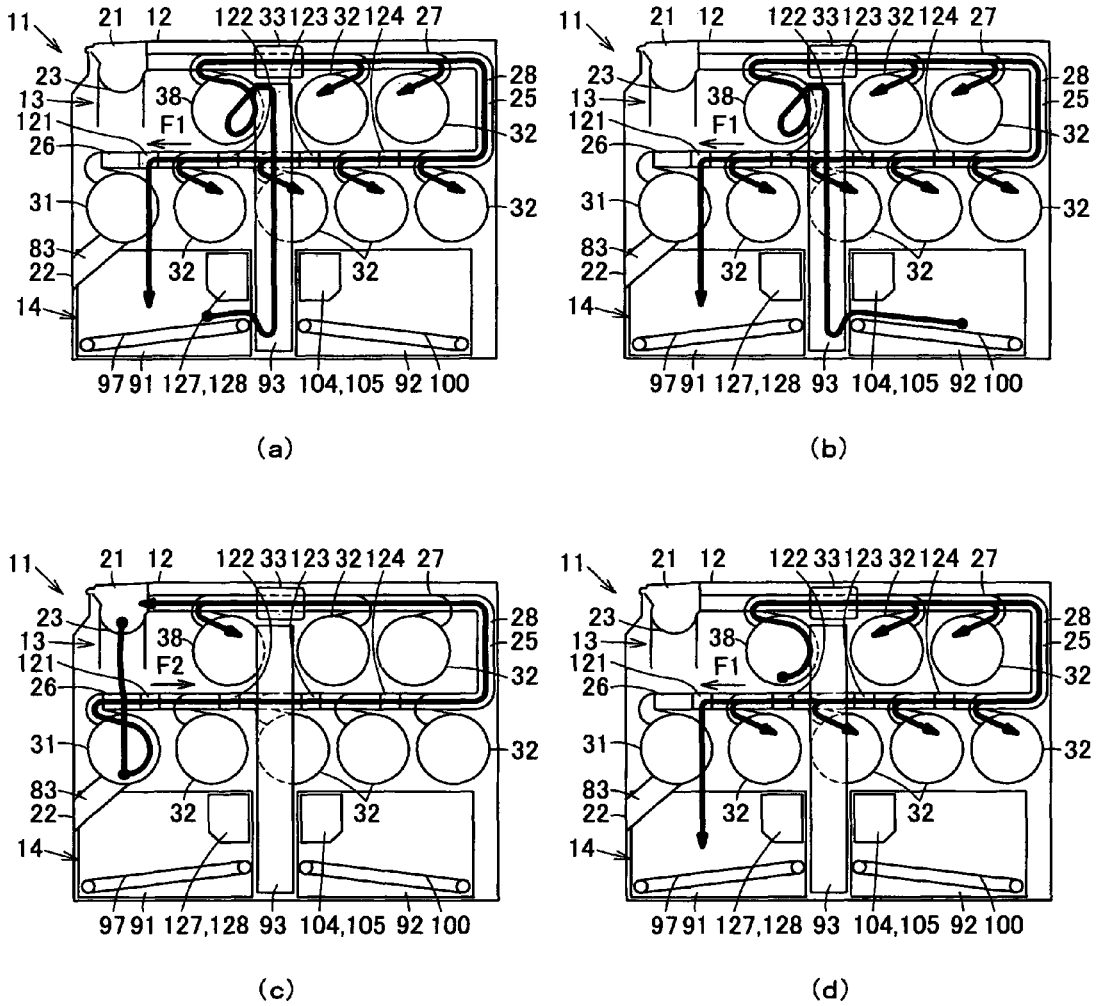
FIG. 18 show a replenishing operation of the same coin handling machine, and FIG. 18(*a*) is an explanatory view showing replenishment processing from the overflow stacking unit, FIG. 18(*b*) is an explanatory view showing replenishment processing from the coin cassette, FIG. 18(*c*) is an explanatory view showing a coin replenishing operation from the inlet/outlet, and FIG. 18(*d*) is an explanatory view showing a coin replenishing operation from the inlet/outlet, following FIG. 18(*c*)

FIG. 18(*a*) shows replenishment processing from the overflow stacking unit 91.

The replenishment processing from the overflow stacking unit 91 is performed when the coin amount in the storing and feeding unit 32 of a certain denomination decreases and coins of this denomination are stored in the overflow stacking unit 91 during operation of the coin handling machine 11.

The belt 97 of the overflow stacking unit 91 rotates to eject the coins in the overflow stacking unit 91 to the conveyor 110 of the replenishment transport path 93. The coins are transported upward by the vertical transport unit 109 of the conveyor 110, and ejected from the upper portion of the vertical transport unit 109 to the escrow unit 38.

Coins are fed out one by one from the escrow unit 38 to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted from the depositing and dispensing transport path 25 into the storing and feeding unit 32 storing coins of the corresponding denomination by the sorting member 47 of the storing and feeding unit 32, and stored in the storing and feeding unit 32.

When the number of stored coins in the storing and feeding unit 32 reaches a predetermined number, subsequent coins of this denomination are regarded as overflowing coins, and diverted by the overflowing coin diverting unit 121 and sent into and stored in the overflow stacking unit 91.

A coin not recognized as a normal coin as a result of recognition by the recognition unit 33 is diverted by the overflowing coin diverting unit 121 and sent into and stored in the overflow stacking unit 91.

Further, FIG. 18(*b*) shows replenishment processing from the coin cassette 92.

The replenishment processing from the coin cassette 92 includes initial replenishment to be performed when no coins are stored in the coin handling machine 11, and mid-process replenishment to be performed when a coin amount in the storing and feeding unit 32 including the overflow stacking unit 91 decreases.

The belt 100 of the coin cassette 92 rotates to eject coins in the coin cassette 92 to the conveyor 110 of the replenishment transport path 93. The coins are transported upward by the vertical transport unit 109 of the conveyor 110, and ejected from the upper portion of the vertical transport unit 109 to the escrow unit 38.

The coins are fed out one by one from the escrow unit 38 to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted from the depositing and dispensing transport path 25 into the storing and feeding unit 32 storing coins of the corresponding denomination by the sorting member 47 of the storing and feeding unit 32, and stored in the storing and feeding unit 32.

When the number of stored coins in the storing and feeding unit 32 reaches a predetermined number, subsequent coins of this denomination are regarded as overflowing coins, and diverted by the overflowing coin diverting unit 121 and sent into and stored in the overflow stacking unit 91.

A coin not recognized as a normal coin as a result of recognition by the recognition unit 33 is diverted by the rejected coin diverting unit 123, and sent into and stored in the replenishment reject box 105.

Moreover, FIG. 18(*c*) and FIG. 18(*d*) show replenishment processing from the inlet/outlet 21.

As shown in FIG. 18(*c*), coins for replenishment input into the tray 23 from the inlet/outlet 21 on the upper surface of the machine body 12 are ejected to the depositing and feeding unit 31 by turning over of the tray 23. The tray 23 is restored to the posture for receiving and storing coins after being turned over.

The coins received in the depositing and feeding unit 31 are fed out one by one to the depositing and dispensing transport path 25, and the coins fed out into the depositing and dispensing transport path 25 are transported one by one in the dispensing transporting direction F2 by the belt 43, and the coins being transported are recognized by the recognition unit 33.

A coin recognized as a normal coin as a result of recognition by the recognition unit 33 is sorted from the depositing and dispensing transport path 25 into the escrow unit 38 by the sorting member 47 of the escrow unit 38, and stored in the escrow unit 38.

A coin not recognized as a normal coin as a result of recognition by the recognition unit 33 passes through the position of the escrow unit 38 and is ejected to the tray 23 restored to the posture for receiving and storing coins from the depositing and dispensing transport path 25, and returned.

As shown in FIG. 18(*d*), after the counting and escrowing operation is finished for all input coins, when a coin storing command is issued by an operation on the operation unit, coins are fed out one by one from the escrow unit 38 to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted from the depositing and dispensing transport path 25 into the storing and feeding unit 32 storing coins of the corresponding denomination by the sorting member 47 of the storing and feeding unit 32, and stored in the storing and feeding unit 32.

When the number of stored coins in the storing and feeding unit 32 reaches a predetermined number, subsequent coins of this denomination are regarded as overflowing coins, and diverted by the overflowing coin diverting unit 121 and sent into and stored in the overflow stacking unit 91.

A coin not recognized as a normal coin as a result of recognition by the recognition unit 33 is diverted by the overflowing coin diverting unit 121 and sent into and stored in the overflow stacking unit 91.

Next, in FIG. 19, collection processing will be described.

Figure 19:
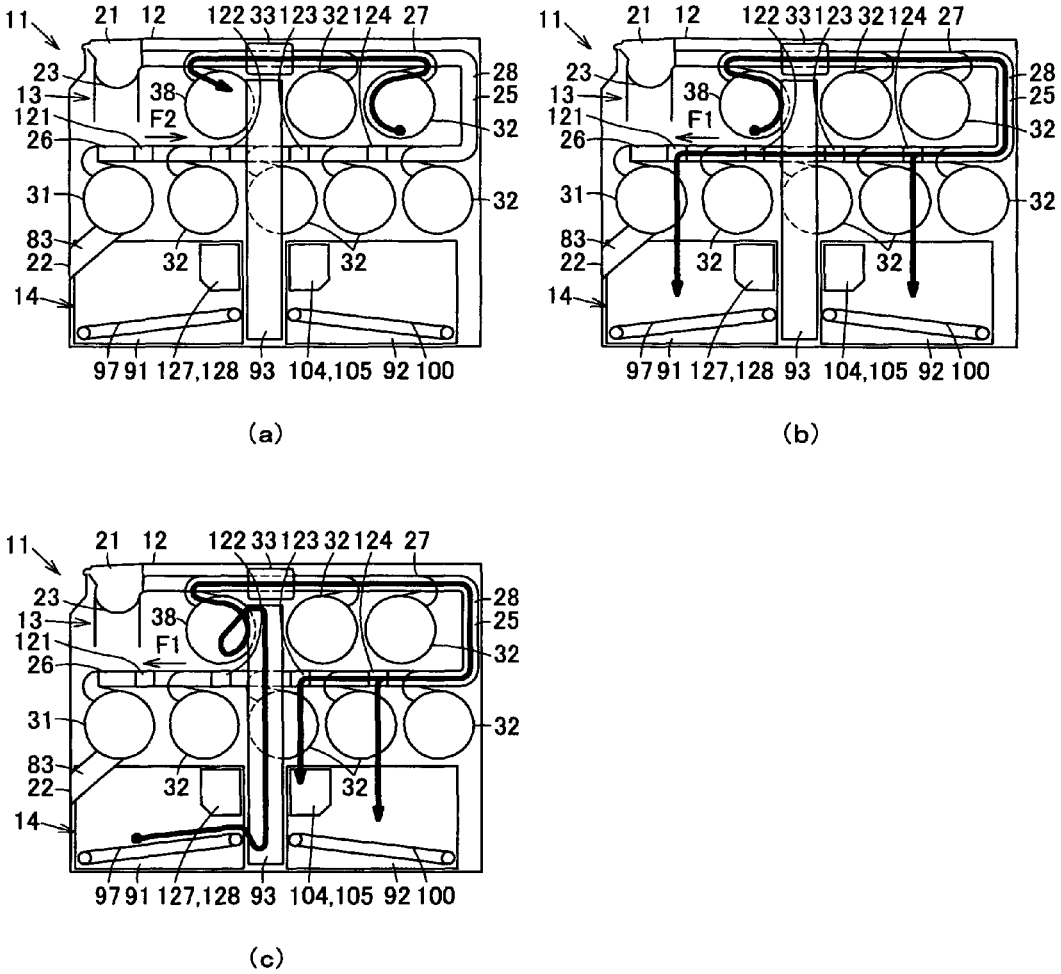
FIG. 19 show collection processing of the same coin handling machine, and FIG. 19(*a*) is an explanatory view showing a collecting operation from the storing and feeding unit, FIG. 19(*b*) is an explanatory view showing a collecting operation from the storing and feeding unit, following FIG. 19(*a*), and FIG. 19(*c*) is an explanatory view showing a collecting operation from the overflow stacking unit.

FIG. 19(*a*) and FIG. 19(*b*) show a collecting operation from the storing and feeding unit 32.

As shown in FIG. 1(*a*), when a collecting command is issued by an operation on the operation unit, coins in a certain storing and feeding unit 32 are fed out one by one to the depositing and dispensing transport path 25, and the coins fed out into the depositing and dispensing transport path 25 are transported one by one in the dispensing transporting direction F2 by the belt 43, and the coins being transported are recognized by the recognition unit 33, and then sorted into and stored in the escrow unit 38 by the sorting member 47 of the escrow unit 38.

Subsequently, as shown in FIG. 19(*b*), coins are fed out one by one from the escrow unit 38 to the depositing and dispensing transport path 25, and the coins fed out into the depositing and dispensing transport path 25 are transported, one by one in the depositing transporting direction F1 by the belt 43, and the coins being transported are recognized by the recognition unit 33.

A coin recognized as a normal coin as a result of recognition by the recognition unit 33 is diverted by the collected coin diverting unit 124, and sent into and stored in the coin cassette 92.

A coin not recognized as a normal coin as a result of recognition by the recognition unit 33 is diverted by the overflowing coin diverting unit 121 and sent into and stored in the overflow stacking unit 91.

Then, such collecting operation is performed for all storing and feeding units 32 in order.

Further, FIG. 19(*c*) shows collection processing from the overflow stacking unit 91.

The belt 97 of the overflow stacking unit 91 rotates to eject coins in the overflow stacking unit 91 from the overflow stacking unit 91 to the conveyor 110 of the replenishment transport path 93. The coins are transported upward by the vertical transport unit 109 of the conveyor 110, and ejected from the upper portion of the vertical transport unit 109 to the escrow unit 38.

The coins are fed out one by one from the escrow unit 38 to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is diverted by the collected coin diverting unit 124 and sent into and collected in the coin cassette 92.

A coin not recognized as a normal coin as a result of recognition by the recognition unit 33 is diverted by the rejected coin diverting unit 123 and sent into and collected in the operational reject box 104.

Next, in FIG. 20, verification processing will be described.

Figure 20:
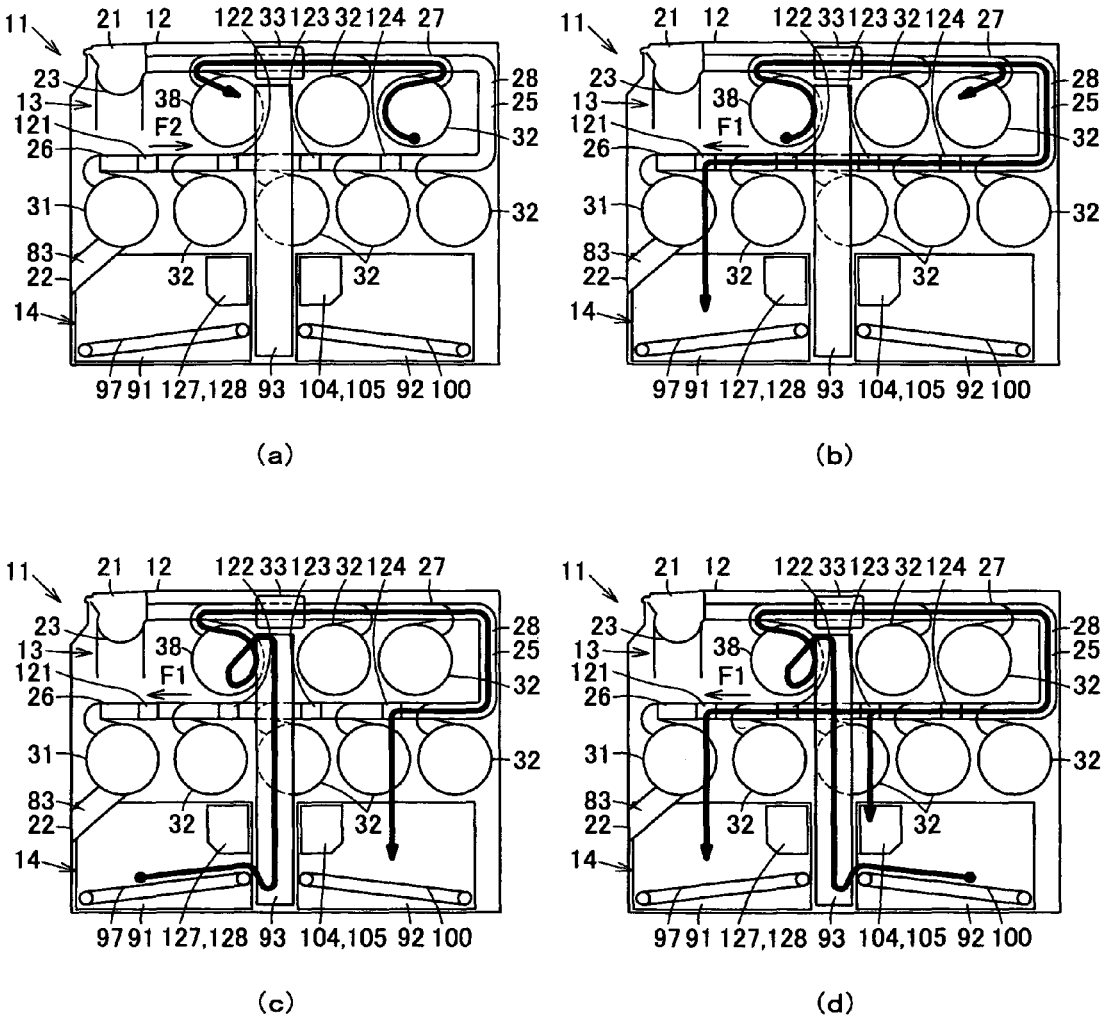
FIG. 20 show verification processing of the same coin handling machine, and FIG. 20(*a*) is an explanatory view showing a verifying operation of the storing and feeding unit, FIG. 20(*b*) is an explanatory view showing a verifying operation of the storing and feeding unit, following FIG. 20(*a*), FIG. 20(*c*) is an explanatory view showing a verifying operation of the overflow stacking unit, and FIG. 20(*d*) is an explanatory view showing a verifying operation of the overflow stacking unit, following FIG. 20(*c*).

FIG. 20(*a*) and FIG. 20(*b*) show verification processing of the storing and feeding unit 32.

As shown in FIG. 20(*a*), when a verifying command is received, from any one of the storing and feeding units 32, coins in the storing and feeding unit 32 are fed out one by one to the depositing and dispensing transport path 25, and the coins fed out into the depositing and dispensing transport path 25 are transported one by one in the dispensing transporting direction F2 by the belt 43, and the coins being transported are recognized by the recognition unit 33, and then sorted into and stored in the escrow unit 38 by the sorting member 47 of the escrow unit 38.

Subsequently, as shown in FIG. 20(*b*), after all coins in the storing and feeding unit 32 to be verified are recognized and moved to the escrow unit 38, coins in the escrow unit 38 are fed out one by one to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is sorted from the depositing and dispensing transport path 25 to the storing and feeding unit 32 storing coins of the corresponding denomination by the sorting member 47 of the storing and feeding unit 32, and stored in the storing and feeding unit 32.

A coin not recognized as a normal coin as a result of recognition by the recognition unit 33 is diverted by the overflowing coin diverting unit 121 and sent into and stored in the overflow stacking unit 91.

Then, after coins are recognized and moved from the storing and feeding units 32 to the escrow unit 38 as described above, the recognition and movement of the coins from the escrow unit 38 to the original storing and feeding unit 32 are performed in order for all storing and feeding units 32 to verify the coins stored in all storing and feeding units 32 in the machine body 12.

Further, FIG. 20(*c*) and FIG. 20(*d*) show a verifying operation of the overflow stacking unit 91.

The verifying operation for coins stored in the overflow stacking unit 91 can be performed only when it is confirmed that no coin is stored in the coin cassette 92, and cannot be performed when coins are stored in the coin cassette 92.

As shown in FIG. 20(*c*), the belt 97 of the overflow stacking unit 91 rotates to eject coins in the overflow stacking unit 91 to the conveyor 110 of the replenishment transport path 93. The coins are transported upward by the vertical transport unit 109 of the conveyor 110, and ejected from the upper portion of the vertical transport unit 109 to the escrow unit 38.

The coins are fed out one by one from the escrow unit 38 to the depositing and dispensing transport path 25, and the coins fed out into the depositing and dispensing transport path 25 are transported one by one in the depositing transporting direction F1 by the belt 43, and the coins being transported are recognized by the recognition unit 33, and then diverted by the collected coin diverting unit 124 and sent into and stored in the coin cassette 92.

Moreover, as shown in FIG. 20(*d*), after the moving operation for the coins fed out from the overflow stacking unit 91, the belt 100 of the coin cassette 92 rotates to eject the coins in the coin cassette 92 to the conveyor 110 of the replenishment transport path 93. The coins are transported upward by the vertical transport unit 109 of the conveyor 110, and ejected from the upper portion of the vertical transport unit 109 to the escrow unit 38.

The coins are fed out one by one from the escrow unit 38 to the depositing and dispensing transport path 25, and the coins fed out into the depositing and dispensing transport path 25 are transported one by one in the depositing transporting direction F1 by the belt 43, and the coins being transported are recognized by the recognition unit 33.

A coin recognized as a normal coin as a result of recognition by the recognition unit 33 is diverted by the overflowing coin diverting unit 121 and sent into and stored in the overflow stacking unit 91.

A coin not recognized as a normal coin as a result of recognition by the recognition unit 33 is diverted by the rejected coin diverting unit 123, and sent into and stored in the operational reject box 104.

In the coin handling machine 11 thus configured, each of the depositing and feeding unit 31, the plurality of storing and feeding units 32, and the escrow unit 38 uses a configuration including the rotary disk 60 which rotates at a position inclined at a predetermined angle with respect to the horizontal direction and the hopper 61 which stores coins in an unaligned state on the surface side of the rotary disk 60 so as to receive coins from the depositing and dispensing transport path 25 and feed out coins one by one to the depositing and dispensing transport path 25 by rotation of the rotary disk 60, so that while the coin handling machine 11 is capable of handling a large amount of coins at a time, the coin handling machine 11 has a transportation structure which can be simplified, reduced in size and cost, and can reduce the occurrence of trouble such as coin jams, and replenish coins from the replenishing and collecting unit 14 to the depositing and dispensing unit 13, handle a large amount of dispenses, store and collect coins sent from the depositing and dispensing unit 13, and handle a large amount of coins.

Further, in each embodiment described above, the coin cassette 92 may be removably disposed on the front portion side of the machine body 12, and the overflow stacking unit 91 may be fixedly disposed on the rear portion side of the machine body 12.

Also, the rejected coins may be stored in either the operational reject box 102 and replenishment reject box 103 of the overflow stacking unit 91 or the operational reject box 104 and replenishment reject box 105 of the coin cassette 92, and the boxes in which rejected coins are to be stored can be selected and set according to an operation method.

Industrial Applicability

The present invention is applicable to a coin handling machine having a deposit function and a dispensing function to be used in retail stores, etc.

The invention claimed is:

1. A coin handling machine comprising:

a depositing and dispensing unit which processes depositing and dispensing of coins, and a replenishing and collecting unit disposed below the depositing and dispensing unit, which replenishes coins to the depositing and dispensing unit and collects coins from the depositing and dispensing unit, wherein the depositing and dispensing unit includes:

a depositing and dispensing transport path which transports coins;

an inlet/outlet which receives coins from the outside of the machine body and dispenses coins transported through the depositing and dispensing transport path to the outside of the machine body;

a depositing and feeding unit which includes a rotary disk that rotates at a position inclined at a predetermined angle with respect to the horizontal direction and a hopper that stores coins in an unaligned state on the surface side of the rotary disk, and receives and stores coins received from the inlet/outlet, and feeds out coins one by one to the depositing and dispensing transport path by rotation of the rotary disk;

a recognition unit which recognizes coins being transported through the depositing and dispensing transport path; and a plurality of storing and feeding units which includes a rotary disk that rotates at a position inclined at a predetermined angle with respect to the horizontal direction and a hopper that stores coins in an unaligned state on the surface side of the rotary disk, receives and stores coins transported through the depositing and dispensing transport path according to recognition results by the recognition unit in response to a coin storing command, and feeds out coins one by one to the depositing and dispensing transport path by rotation of the rotary disk in response to a coin dispensing command, and the replenishing and collecting unit includes:

a coin storing unit which is capable of feeding out stored coins and is capable of storing coins sent from the depositing and dispensing unit, and a replenishment transport path which transports coins fed out from the coin storing unit to the depositing and dispensing unit.

2. The coin handling machine according to claim 1, further comprising an escrow unit that is positioned higher than the depositing and feeding unit, receives and stores coins fed out from the depositing and feeding unit and recognized as normal coins by the recognition unit from the depositing and dispensing transport path, and sends coins to the depositing and feeding unit in response to the coin storing command.

3. The coin handling machine according to claim 1, further comprising an escrow unit which includes a rotary disk which rotates at a position inclined at a predetermined angle with respect to the horizontal direction and a hopper which stores coins in an unaligned state on the surface side of the rotary disk, receives and stores coins fed out from the depositing and feeding unit and recognized as normal coins by the recognition unit from the depositing and dispensing transport path, and feeds out coins one by one to the depositing and dispensing transport path by rotation of the rotary disk in response to the coin storing command.

4. The coin handling machine according to claim 1, further comprising an escrow unit which receives and stores coins fed out from the depositing and feeding unit and recognized as normal coins by the recognition unit from the depositing and dispensing transport path, and the coin storing unit includes:

an overflow stacking unit which is fixedly disposed on the machine body, and receives and stores coins of a denomination of which the storing and feeding unit has become full among coins sent out from the escrow unit and transported through the depositing and dispensing transport path according to recognition results by the recognition unit in response to the coin storing command, and is capable of feeding out the stored coins; and a coin cassette which is removably disposed on the machine body and capable of feeding out stored coins and store coins collected from the inside of the machine body.

5. The coin handling machine according to claim 1, wherein the coin storing unit stores coins in an unaligned state, and is capable of feeding out coins to the replenishment transport path by rotation of a belt constituting the bottom portion of a space for storing the coins.

6. The coin handling machine according to claim 1, wherein the replenishing and collecting unit is disposed below the depositing and dispensing unit, and the replenishment transport path includes a horizontal transport unit which receives coins fed out from the coin storing unit and transports the coins horizontally, and a vertical transport unit which transports the replenishment coins upward from the horizontal transport unit.

7. The coin handling machine according to claim 6, wherein the vertical transport unit of the replenishment transport path is positioned on a side portion of the depositing and dispensing unit, and is capable of leaving a space between the vertical transport unit and the depositing and dispensing unit.

8. The coin handling machine according to claim 1, wherein the coin storing unit includes a reject box which stores rejected coins not recognized as normal coins by the recognition unit of the depositing and dispensing unit.

9. The coin handling machine according to claim 8, wherein the reject box includes an operational reject box which stores rejected coins at the time of depositing and dispensing operation, and a replenishment reject box which stores rejected coins at the time of replenishment.

10. The coin handling machine according to claim 4, wherein the coin cassette includes an operational reject box which stores rejected coins not recognized as normal coins by the recognition unit of the depositing and dispensing unit at the time of depositing and dispensing operation, and a replenishment reject box which stores rejected coins not recognized as normal coins by the recognition unit of the depositing and dispensing unit at the time of replenishment, and these operational reject box and replenishment reject box are removably attached to the machine body, integrally with the coin cassette.

11. The coin handling machine according to claim 10, wherein the overflow stacking unit includes an operational reject box which stores rejected coins not recognized as normal coins by the recognition unit of the depositing and dispensing unit at the time of depositing and dispensing operation, and a replenishment reject box which stores rejected coins not recognized as normal coins by the recognition unit of the depositing and dispensing unit at the time of replenishment, and these operational reject box and replenishment reject box are removable from the machine body.

12. The coin handling machine according to claim 10, wherein the overflow stacking unit includes a forgotten-to-be-taken box which stores forgotten-to-be-taken coins which were dispensed to the inlet/outlet and are not taken out, and an auxiliary box which can store coins, and these forgotten-to-be-taken box and auxiliary box are removable from the machine body.

* * * * *